US006171775B1

(12) United States Patent
Nishikawa

(10) Patent No.: US 6,171,775 B1
(45) Date of Patent: Jan. 9, 2001

(54) SILVER HALIDE EMULSION AND LIGHTSENSITIVE MATERIAL INCLUDING THE SAME

(75) Inventor: Toshihiro Nishikawa, Minami-ashigara (JP)

(73) Assignee: Fuji Photo Film Co., Ltd., Kanagawa (JP)

( * ) Notice: Under 35 U.S.C. 154(b), the term of this patent shall be extended for 0 days.

(21) Appl. No.: 09/079,220

(22) Filed: May 15, 1998

(30) Foreign Application Priority Data

May 16, 1997 (JP) ..... 9-141197

(51) Int. Cl.[7] ..... G03C 1/005; G03C 1/035
(52) U.S. Cl. ..... 430/567
(58) Field of Search ..... 430/567

(56) References Cited

U.S. PATENT DOCUMENTS 5,405,738 * 4/1995 Uchida ..... 430/567
5,563,025 * 10/1996 Ishii et al. ..... 430/567
5,807,665 * 9/1998 Saitou ..... 430/567
6,017,684 * 1/2000 Miyake ..... 430/351

FOREIGN PATENT DOCUMENTS 8-334849 12/1996 (JP) .

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A silver halide emulsion comprising a dispersion medium and silver halide grains, wherein at least 60% of the total projected area of all the silver halide grains in the emulsion are occupied by tabular grains each of which have {100} faces as principal planes; an aspect ratio of at least 2.0 but less than 100; a length to width ratio (long side/short side) in a form of a right angled parallelogram of 1 to 6, wherein the right angled parallelogram is the one that is surrounded by the {100} faces at the edges of the tabular grain or that is shaped by extending the {100} faces at the edges of the tabular grain; and at least one dislocation line.

13 Claims, 1 Drawing Sheet

SILVER HALIDE EMULSION AND LIGHTSENSITIVE MATERIAL INCLUDING THE SAME

BACKGROUND OF THE INVENTION

The present invention relates to an emulsion of silver halide (hereinafter silver halide is also referred to as "AgX") which is useful in the field of photography. More particularly, the present invention relates to a silver halide emulsion which is excellent in sensitivity, image quality and pressure properties. The present invention also relates to a silver halide lightsensitive material using the same.

The spectral sensitization, sharpness, light scattering performance, covering power, rate of development, graininess, etc. are improved as compared with those of the lightsensitive material using nontabular silver halide grains, when tabular silver halide emulsion grains are used in a photographic lightsensitive material. Therefore, tabular grains having mutually parallel twin planes and having hexagonal principal planes composed of {111} faces (hereinafter referred to as "{111} tabular grains") are now often used.

These grains are described in detail in, for example, Jpn. Pat. Appln. KOKAI Publication No. (hereinafter referred to as JP-A-) 58-113926, JP-A-58-113927, JP-A-58-113928, JP-A-2-828, JP-A-2-28638 and JP-A-2-298935.

However, when a large amount of a spectral sensitizing dye is adsorbed on silver halide grains, grains having {100} faces exhibit spectral sensitization performance more desirable than that of grains having {111} faces. This tendency is manifest from a comparison of cubic grains having principal planes composed of {100} faces to octahedral grains having principal planes composed of {111} faces. Therefore, there is a demand for the development of tabular grains having principal planes composed of {100} faces (hereinafter referred to as {100} tabular grains) which replace the conventionally employed {111} tabular grains.

Although reports on {100} tabular grains having principal planes shaped into a right angled parallelogram are a few, such tabular grains are described in, for example, JP-A-51-88017 and Jpn. Pat. Appln. KOKOKU Publication No. (hereinafter referred to as JP-B-) 64-8323.

A. MIGNOT, E. FRANCOIS AND M. CATINAT, "CRISTAUX DE BROMURE D'ARGENT PLATS, LIMITES PAR DES FACES {100} ET NON MACLES", Journal of Crystal Growth 123 (1974) 207–213 reports an observation of tabular silver bromide crystals composed of {100} faces having square or rectangular principal planes.

As disclosed in U.S. Pat. No. 4,063,951, tabular grains defined by {100} crystal faces are formed from monodispersed seed grains, and tabular grains having an average aspect ratio of 1.5 to 7 are produced by ripening in the presence of ammonia. On the other hand, U.S. Pat. No. 4,386,156 discloses a process for producing a tabular silver bromide emulsion having an average aspect ratio of at least 8, in which seed grains are ripened in the absence of nonhalide silver ion completing agents.

The inventor incorporated a tabular emulsion having principal planes composed of {100} crystal faces in a lightsensitive material and evaluated the performance of the lightsensitive material. When a pressure was applied to the lightsensitive material, the occurrence of fog (called "stress marks" in the art of photography) was observed to which a complaint for compensation would be laid on the market.

The inventor has studied a technology for overcoming the stress marks and has completed the present invention.

BRIEF SUMMARY OF THE INVENTION

Therefore, an object of the present invention is to provide a silver halide emulsion which is excellent in sensitivity and pressure properties and to provide a lightsensitive material using the same.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the preferred embodiments given below, serve to explain the principles of the invention.

DETAILED DESCRIPTION OF THE INVENTION

Figure 1:
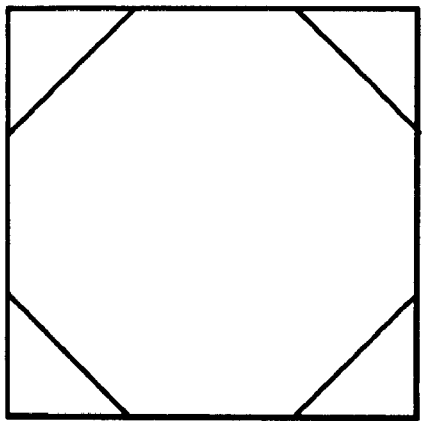
FIG. 1 is a plan view of tetradecahedral AgX grains.

The object of the present invention has been attained by:

(1) A silver halide emulsion comprising a dispersion medium and silver halide grains, wherein at least 60% of the total projected area of all the silver halide grains are occupied by tabular grains each of which have {100} faces as principal planes, an aspect ratio (diameter/thickness) of at least 2.0 but less than 100, and at least one dislocation line; and in a form of a right angled parallelogram that is surrounded by the {100} faces at the edges of the tabular grain or that is shaped by extending the {100} faces at the edges of the tabular grain, a length to width ratio (long side/short side) is 1 to 6;

(2) The silver halide emulsion as recited in item (1) above, wherein the emulsion was produced in the presence of a compound $A^0$ and/or compound $B^0$, wherein the compound $A^0$ is an organic compound constructed of a molecule and covalently bonded at least two residual groups of adsorbent thereto, that is capable of promoting formation of {100} faces in each silver halide grain;

the compound $B^0$ is an organic compound having at least two alcoholic hydroxy groups per molecule;

and the compound $A^0$ and compound $B^0$ are organic compounds other than gelatin and protein;

(3) The silver halide emulsion as recited in item (1) or (2) above, wherein the emulsion further comprises at least one radical scavenger;

(4) The silver halide emulsion as recited in any one of items (1) to (3) above, wherein the radical scavenger is represented by any of the following formulae (A—I) to (A—V):

general formula (A-I)

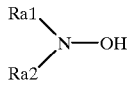

general formula (A-II)

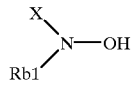

general formula (A-III)

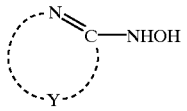

general formula (A-IV)

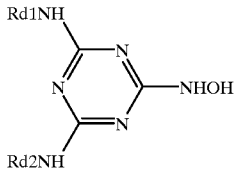

general formula (A-V)

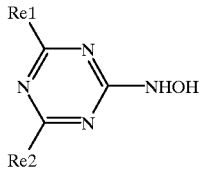

wherein, in the general formula (A—I), Ra1 represents an alkyl group, an alkenyl group, an aryl group, an acyl group, an alkyl- or arylsulfonyl group, an alkyl- or arylsulfinyl group, a carbamoyl group, a sulfamoyl group, an alkoxycarbonyl group or an aryloxycarbonyl group; and Ra2 represents a hydrogen atom or a group represented by Ra1, provided that, when Ra1 is an alkyl group, an alkenyl group or an aryl group, Ra2 represents an acyl group, an alkyl- or arylsulfonyl group, an alkyl- or arylsulfinyl group, a carbamoyl group, a sulfamoyl group, an alkoxycarbonyl group or an aryloxycarbonyl group and provided that Ra1 and Ra2 may be bonded together to form a 5 to 7-membered ring;

in the general formula (A—II), X represents a heteroring group; and R1 represents an alkyl group, an alkenyl group or an aryl group, provided that X and Rb1 may be bonded together to form a 5 to 7-membered ring;

in the general formula (A—III), Y represents a nonmetallic atom group required to form a 5-membered ring together with the —N═C— group or represents a nonmetallic atom group required to form a 6-membered ring together with the —N═C— group, wherein the terminal portion of Y at which Y bonds with the carbon atom of the —N═C— group is a group selected from the group consisting of —N(Rc1)—, —C(Rc2)(Rc3)—, —C(Rc4)═, —O— and —S—, each of which bonds with the carbon atom of the —N═C— group via the left side bond thereof, and the above Rc1 to Rc4 each represent a hydrogen atom or a substituent;

in the general formula (A—IV), Rd1 and Rd2 may be the same or different from each other and each represent an alkyl group or an aryl group, provided that, when both Rd1 and Rd2 are the same unsubstituted alkyl groups, each of Rd1 and Rd2 represents an alkyl group having at least 8 carbon atoms; and in the general formula (A—V), Re1 and Re2 may be the same or different from each other and each represent a hydroxylamino group, a hydroxyl group, an amino group, an alkylamino group, an arylamino group, an alkoxy group, an aryloxy group, an alkylthio group, an arylthio group, an alkyl group or an aryl group, provided that Re1 and Re2 do not simultaneously represent —NHRe3, wherein Re3 represents an alkyl group or an aryl group.

Preferred modes of the emulsion of the present invention are as follows:

(5) The silver halide emulsion recited in any one of items (1) to (4) above, wherein the silver bromide content of the silver halide emulsion is at least 50 mol %;

(6) The silver halide emulsion recited in any one of items (1) to (5) above, wherein the compound $A^0$ is a polymer of at least one ethylenically unsaturated monomer and has at least two imidazole groups or benzimidazole groups per molecule thereof;

(7) The silver halide emulsion recited in any one of items (1) to (6) above, wherein the compound $B^0$ is a polyvinyl alcohol having a molecular weight of at least 300 and has an X1 value per molecule of 0.2 to 1.0, wherein the X1 value is a ratio of number of alcohol groups/number of all functional groups; and (8) The silver halide emulsion recited in any one of items (1) to (7) above, wherein the compound $A^0$ and/or compound $B^0$ is present in such a concentration that can provide an amount of an equilibrium crystal habit potential shift of at least 10 mV.

The present invention also provide a color lightsensitive material comprising the silver halide emulsion recited in any one of items (1) to (8) above.

The present invention will now be described in greater detail.

The above compound $A^0$ is represented by the general formula (1) below:

$$—(A)a—(B)b— \quad (1)$$

wherein a and b represent the weight percentages of respective components, and a+b=100.

(I) Compound $A^0$ will be described in detail below:

The compound $A^0$ is an organic compound having, per molecule, at least two, preferably, 4 to $10^3$, more preferably, 8 to 100 and, most preferably, 20 to 100 covalently bonded residual groups of adsorbent $C^0$ capable of promoting formation of {100} faces of the silver halide grains. The compound $A^0$ refers to a compound having the following characteristics under the conditions of the experiments set forth below:

First, regular crystal silver halide emulsion grains having an average diameter of approximately 0.2 μm are formed in the presence of conventional photographic gelatin. An equal amount of samples each containing the regular crystal AgX grains in a number of $N^0$ are taken as seed crystals from the emulsion. One of the samples is put in an aqueous solution of conventional photographic gelatin dispersion medium, and $Ag^+$ and Br— are added by a double jet method at 60° C. while maintaining the silver potential at a constant value, thereby growing the seed crystal to an average diameter of approximately 1.0 μm without rendering any new nuclei being formed. The same experiments as above are conducted, except that the silver potential is varied to thereby determine the relationship of silver potential versus grain configuration. On the other hand, the compound $A^0$ having covalently bonded residual groups of $C^0$ as mentioned above is added in an amount corresponding to 30% by weight of the weight of gelatin contained in the above aqueous solution, and the same experiments are conducted to thereby determine the relationship of silver potential versus grain configuration. The gelatin content of the aqueous solution at the initiation of grain growth is 18 g/liter (hereinafter liter is referred to as "L"). The addition amount of $Ag^+$ is 70 g in terms of $AgNO_3$. The pH is a constant value over the pKa value of $A^0$, preferably, (pKa+0.5). Herein, the pKa value is an acid dissociation constant value. The silver potential is the potential of silver rod against calomel electrode saturated at room temperature. With respect to the silver potential, an AgBr electrode, an AgI electrode, an $Ag_2S$ electrode or a mixed crystal electrode composed of at least two members selected from among these can be used in place of the silver rod. In any case, however, the comparative experiments between with and without the compound $A^0$ are performed under the same conditions, except that the compound $A^0$ is added on the one hand and is not added on the other hand.

As a result of the comparative experiments, such a relationship is recognized that, in the latter instance (compound $A^0$ having covalently bonded residual groups of $C^0$ is added), the silver potential at which tetradecahedral grains of the identical configuration can be obtained shifts toward a low potential side by at least 10 mV, preferably, 20 to 150 mV, more preferably, 30 to 120 mV and, most preferably, 50 to 100 mV relative to the gelatin system without the compound $A^0$ being added. When such a potential shift toward lower side is realized by causing a certain compound to be present in a certain amount, the amount of potential shift is referred to as the "amount of equilibrium crystal habit potential shift" in the present invention. The tetradecahedral grains are preferably those corresponding to cubic grains having each of the corners deleted by an average of 30% of each side length, and the plan view of the tetradecahedral grains is given in FIG. 1. Regarding other details of the measurement of silver potential, reference can be made to "Ion Selective Electrode" translated by Shin Munemori, et al. and published by Kyoritsu Shuppan Co., Ltd. (1977) and chapter 5 of "Denki Kagaku Binran (Electrochemical Manual)" published by Maruzen Co., Ltd. (1985), the disclosures of which are herein incorporated by reference.

The adsorbent $C^0$ is an organic compound having at least one nitrogen atom N which has a $\pi$ electron pair stabilized by resonance. As examples of the adsorbent $C^0$, heterocyclic compounds containing N in the ring can firstly be mentioned. Examples thereof include saturated or unsaturated heterocycles containing only one N atom in the ring as a heteroatom, which may be substituted (e.g., pyridine, indole, pyrrolidine and quinoline) and saturated or unsaturated heterocycles containing one N atom and at least one heteroatom selected from the group consisting of N and O in the ring, which may be substituted (e.g., imidazoline, imidazole, pyrazole, oxazole, piperazine, triazole, tetrazole, oxadiazole, oxatriazole, dioxazole, pyrimidine, pyrimidazole, pyrazine, triazine, tetrazine and benzimidazole).

Secondly, organic compounds having an aromatic-ring-substituted N atom group, represented by the formula (3) given below, can be mentioned as the adsorbent $C^0$. In the formula, Ar represents an aromatic ring having 5 to 14 carbon atoms, preferably, an aromatic ring composed of a carbon ring. Each of $R^1$ and $R^2$ represents H, Ar, an aliphatic group or both $R^1$ and $R^2$ together can form a 5 or 6-membered ring such as aniline, $\alpha$-naphthylamine, carbazole, 1,8-naphthilidine, nicotine or benzoxazole. For other details, reference can be made to EP 0534395A1 and JP-A-6-19029, the disclosure of which are herein incorporated by reference. Of these compounds, imidazole and benzimidazole are preferred.

(3)

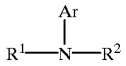

The compound $A^0$ can be produced by polymerizing at least two molecules of polymerizable ethylenically unsaturated monomer represented by the formula (4) given below or by copolymerizing at least one of the same with at least one polymerizable ethylenically unsaturated monomer represented by the formula (5) given below. In the compound $A^0$, the plural repeating units derived from monomers represented by the formula (4) may be a single species or a mixture of a plurality of species. Similarly, the plural repeating units derived from monomers represented by the formula (5) may be a single species or a mixture of a plurality of species. Copolymerization may be conducted in a proportion satisfying the above mode. In the formula (4), $c^1$ represents a residue resulting from the bonding of compound $C^0$ to the monomer. In the formula (5), $d^1$ represents a functional group. The compound of the formula (5) undergoes the above polymerization to thereby form the portion B of the general formula (1) given before and the portion E of the general formula (2) given below.

(4)

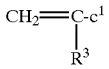

(5)

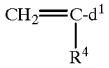

wherein each of $R^3$ and $R^4$ represents a hydrogen atom or an alkyl group having 1 to 10 carbon atoms, preferably, 1 to 5 carbon atoms.

Examples of the compounds represented by the formula (4) include monomers having a heterocyclic group containing a basic nitrogen atom, such as vinylimidazole, 2-methyl-1-vinylimidazole, 4-vinylpyridine, 2-vinylpyridine, N-vinylcarbazole, 4-acrylamidopyridine, N-acryloylimidazole, N-2-acryloyloxyethylimidazole, 4-N-(2-acryloyloxyethyl)aminopyridine, 1-vinylbenzimidazole, N-vinylbenzylimidazole, N-methacryloyloxyethylpyrrolidine, N-acryloylpiperadine, 1-vinyltriazole, 3,5-dimethyl-1-vinylpyrazole, N-methacryloyloxyethylmorpholine, N-vinylbenzylpiperidine and N-vinylbenzylmorpholine.

It is preferred that the copolymerizable ethylenically unsaturated monomer capable of forming B be one whose homopolymer is soluble in one of acidic, neutral and alkaline aqueous solutions. Suitable compound examples thereof include nonionic monomers such as acrylamide, methacrylamide, N-methylacrylamide, N,N-dimethylacrylamide, N-acryloylmorpholine, N-ethylacrylamide, diacetonacrylamide, N-vinylpyrrolidone and N-vinylacetamide; anionic group-having monomers such as acrylic acid, methacrylic acid, itaconic acid, vinylbenzoic acid, styrenesulfonic acid, styrenesulfinic acid, phosphonoxyethyl acrylate, phosphonoxyethyl methacrylate, 2-acrylamido-2-methylpropanesulfonic acid and 3-acrylamidopropionic acid or salts thereof; and cationic group-having monomers such as N,N,N-trimethyl-N-vinylbenzylammonium chloride and N,N,N-trimethyl-N-3-acrylamidopropylammonium chloride.

B is a copolymer of at least one monomer selected from among the above. Another hydrophobic ethylenically unsaturated monomer can be copolymerized into B in an amount not detrimental to the water solubility of the entire molecule of the formula (1).

The other hydrophobic ethylenically unsaturated monomer is selected from among, for example, ethylene, propylene, 1-butene, styrene, α-methylstyrene, methyl vinyl ketone, monoethylenically unsaturated esters of fatty acids (e.g., vinyl acetate and allyl acetate), esters of ethylenically unsaturated monocarboxylic or dicarboxylic acid (e.g., methacrylic acid esters), amides of ethylenically unsaturated monocarboxylic acid (e.g., t-butylacrylamide), monoethylenically unsaturated compounds (e.g., acrylonitrile and methacrylonitrile) and dienes (e.g., butadiene and isoprene).

In the formula (1), a is in the range of (0.002 to 1.0)×100, preferably, (0.01 to 0.8)×100, more preferably, (0.05 to 0.7)×100 and, much more preferably, (0.15 to 0.6)×100. The molecular weight of the compound $A^0$ ranges from 150 to $10^6$, preferably, 300 to $3\times10^5$ and, more preferably, $10^3$ to $3\times10^5$.

With respect to the chemical bond combining $c^1$ and the ethylenically unsaturated monomer in the formula (4), a divalent connecting group L may be interposed as in $H_2C{=}C(H)—L—c^1$, as well as is in a mode of direct bonding as in the formula (4) described above. For example, $H_2C{=}C(H)—CONH—c^1$ and $H_2C{=}C(H)—COO—c^1$ can be mentioned as modes of indirect bonding. For details of the divalent connecting group and the bonding mode thereof, reference can be made to the description of JP-A-3-109539 and JP-A-4-226449, the disclosure of which are herein incorporated by reference.

The compound $A^0$ is more generally a polymer of at least two, preferably, 4 to $10^3$, more preferably, 8 to 100 and, much more preferably, 20 to 100 molecules of polymerizable monomers each having a $c^1$ group. The compound $A^0$ can be obtained by polymerizing the polymerizable monomer having a $c^1$ group or by bonding a $c^1$ group to an already existing polymer. The polymerization method can be any of the addition polymerization, condensation polymerization, polyaddition polymerization, ring-opening polymerization and addition condensation methods. The addition polymerization of a vinyl compound, a vinylidene compound or a diene compound is preferred, and the addition polymerization of a vinyl compound is especially preferred. For details thereof, reference can be made to Shin Jikken Kagaku Koza (New Experimental Chemistry Course) 19, Kobunshi Kagaku (Polymer Chemistry) [I], Maruzen Co., Ltd. (1978) and the 4th edition of Jikken Kagaku Koza (Experimental Chemistry Course) 28, 29, Maruzen Co., Ltd. (1992), the disclosures of which are herein incorporated by reference. This monomer has at least one, preferably, 1 to 3 and, more preferably, one $c^1$ group. The $c^1$group is not present on the principal chain of the polymer and is bonded thereto as a branch. The compound $A^0$ is preferably a polymer of at least one ethylenically unsaturated monomer, having per molecule thereof at least two, preferably, 4 to $10^3$, more preferably, 8 to 100 and, much more preferably, 20 to 100 imidazole or benzimidazole groups.

(II) Compound $B^0$ will be described in detail below:

The compound $B^0$ is a compound other than gelatin and protein, having a molecular weight of, preferably, at least 90, more preferably, 300 to $10^6$, much more preferably, $10^3$ to $10^5$ and, still much more preferably, 3000 to $10^5$, and containing per molecule thereof at least two, preferably, 4 to $10^5$, more preferably, 10 to $10^4$ and, most preferably, 30 to $10^3$ much more preferably 100 to $10^3$ alcoholic hydroxy groups. Further, the ratio of number of alcoholic hydroxy groups to number of all functional groups (=x1) per molecule is preferably at least 0.05, more preferably, in the range of 0.2 to 1.0, still more preferably, 0.4 to 1.0 and, most preferably, 0.6 to 1.0. The functional group is a residue which is more reactive than hydrocarbon residues such as methyl and the like, and refers to a heteroatom group or an atom group containing a heteroatom. Still further, the ratio of total weight of all alcoholic hydroxy groups to total weight of one molecule (=x2) per molecule is in the range of, preferably, 0.01 to 0.6, more preferably, 0.05 to 0.55 and, most preferably, 0.1 to 0.5.

As practical examples of the compound $B^0$, firstly, carbohydrates can be mentioned. Hereinafter the carbohydrates are also referred to as compound 1). The carbohydrates are polysaccharides satisfying the above requirements for molecular weight and include homopolysaccharides composed of a single constituent sugar and heteropolysaccharides composed of a plurality of constituent sugars. Examples of the constituent sugars include monosaccharides of the molecular formula $(CH_2O)_n$ wherein n ranges from 5 to 7, sugar alcohol, aldonic acid having a —COOH group in place of a —CHO group, uronic acid having a $—CH_2OH$ group converted to a —COOH group and amino sugars. The carbohydrates also include sugar derivatives (e.g., viscose, methylcellulose, ethylcellulose, hydroxyethylcellulose, carboxymethylcellulose, soluble starch, carboxymethyl starch, dialdehyde starch and glycosides). The carbohydrates excluding nucleic acids are preferable and carbohydrates excluding glycosides are more preferable.

Specific examples of the carbohydrates (compound (1)) include starches (cane starch, potato starch, tapioca starch, wheat starch and corn starch), devil's-tongue, glue plant, agar, sodium alginate, Nibicus manihot, tragacanth, gum, gum arabic, dextran, dextrin and levan. Galactose (agar, etc.) is preferably used.

Secondly, polyhydric alcohols can be mentioned as examples of the compounds $B^0$. Hereinafter the polyhydric alcoholes are also referred to as compound 2). These are also called alkane polyols, examples of which include glycerol, glycitol and ethylene glycol.

Thirdly, examples of the compounds $B^0$ include polymers represented by the general formula (2):

$$—(D)d—(E)e— \quad (2)$$

wherein d and e represent the weight percentages of respective components and d+e=100, D represents a repeating unit formed from an ethylenically unsaturated monomer having at least one alcoholic hydroxy group, and E represents a repeating unit other than D, formed from an ethylenically unsaturated monomer. Hereinafter the polymers represents by the general formula (2) is also referred to as compound 3). With respect to the d and e representing the weight percentages of respective components, d ranges from 5 to 100, preferably, 20 to 100 and, more preferably, 40 to 100, and e ranges from 0 to 95, preferably, 0 to 80 and, more preferably, 0 to 60. Examples of the ethylenically unsaturated monomers capable of forming E include the ethylenically unsaturated monomers capable of forming B of the general formula (1) given hereinbefore and the monomers represented by the formula (4) given hereinbefore.

Preferred examples of the compounds 3) include vinyl acetate/polyvinyl alcohol copolymers whose copolymerization ratio can be selected by regulating the degree of saponification of polyvinyl acetate.

For other details of the compounds represented by the formulae (1) and (2) and the method of polymerizing the same, reference can be made to, for example, Teiji Tsuruta, revised edition of "Kobunshi Gosei Hanno (Polymer Synthetic Reaction)", Nikkan Kogyo Shimbunsha (1971); Takayuki Otsu, et al. "Kobunshi Gosei no Jikkenho (Experimental Method for Polymer Synthesis)", Kagaku Dozin, pp. 124–154 (1972); JP-A-6-19029; and the literature for water soluble polymers listed below, the disclosures of which one herein incorporated by reference.

With respect to the compounds 1) to 3), at least two species may jointly be used at an appropriately selected ratio. These compounds in powdery or solution form may directly be added to the reaction mixture or may first be dissolved in an acidic, a neutral or an alkaline water and then added to the reaction mixture. For other details of the compounds 1) to 3), reference can be made to "Shin Suiyosei Polymer no Oyo to Shijo (Application and Market of New Water Soluble Polymer)" edited by Shinji Nagatomo, CMC (1988); "Suiyosei Kobunshi/Mizubunsangata Jushi Sogo Gijutsu Shiryoshu (Comprehensive Technical Data Collection on Water Soluble Polymer/Water Dispersible Resin)" edited by Publishing Division of Keiei Kaihatsu Center, Publishing Division of Keiei Kaihatsu Center (1981); new supplemental 3rd edition of "Suiyosei Kobunshi (Water Soluble Polymer)" edited by Tadanori Misawa, Kagaku Kogyosha (1990); and "Polyvinyl Alcohol" edited by C. A. Finch, John Wiley & Sons (1992) , the disclosures of which one herein incorporated by reference.

(III) Physical Properties of AgX Emulsion will be described in detail below:

In the present invention, the term "projected area" means the projected area of grains arranged on a base in a manner such that AgX emulsion grains are not piled one upon another and such that tabular grains have their principal planes arranged parallel to the base surface. The AgX emulsion of the present invention comprises at least a dispersion medium and AgX grains. At least 60%, preferably, 70 to 100% and, more preferably, 90 to 100% of the total of projected area of all AgX grains in the emulsion is occupied by tabular grains having principal planes composed of {100} faces and having an aspect ratio (diameter/thickness) of at least 2, preferably, 3 to 25 and, more preferably, 4 to 20.

The term "diameter of tabular grains" means, in the specification, the diameter of a circle having the same area as the projected area of each grain as observed by an electron microscope. Such a diameter of tabular grains is also referred to as an equivalent circular diameter. The term "thickness of tabular grains" means the spacing between principal planes of each tabular grain. This thickness is preferably 0.5 μm or less, more preferably, from 0.03 to 0.3 μm and, much more preferably, 0.05 to 0.2 μm. The equivalent circular diameter of the tabular grains is preferably 10 μm or less, more preferably, from 0.2 μm to 5 μm.

The diameter distribution of the grains is preferably monodispersed, and the variation coefficient (standard deviation/average diameter) of the distribution preferably ranges from 0 to 0.4, more preferably, from 0 to 0.3 and, most preferably, from 0 to 0.2.

The term "principal planes" means the maximum outer surface of tabular grains and a pair-forming major outer surface arranged parallel to the maximum outer surface. The projected outlines profile of tabular grains (outline profiles of edge faces observed on a plan view of tabular grains having their principal planes set parallel to a base surface) include (i) a right angled parallelogram, (ii) a form of right angled parallelogram having at least one of its four corners nonequivalently deleted (for details, reference can be made to JP-A-5-313273 and 7-146522), the disclosures of which are herein incorporated by reference, (iii) another form of right angled parallelogram having at least two sides opposite to each other, out of its four sides, curved in outward protrudent form and (iv) a further form of right angled parallelogram having its four corners equivalently deleted [form satisfying the relationship: (area of maximum deleted portion/area of minimum deleted portion) of principal plane in one grain <].

Moreover, a form (v) having {n10} faces between one of the principal planes and one of the edge {100} faces can be mentioned. The above n is an integer of 1 to 5, preferably, 1. The area ratio of {n10} faces to the entire surface of tabular grains preferably ranges from 0.1 to 30%, more preferably, from 1 to 15%. In the forms (ii) and (iv) above, the edge face of the deleted portion can have {111} faces, {n10} faces and both {111} and {n10} faces. This n is as defined above. The forms (i) and (ii) are preferred.

The right angled parallelogram surrounded by the {100} faces at the edges of each tabular grain or the right angled parallelogram shaped by extending the {100} faces at the edges of each tabular grain has a length to width ratio of 1 to 6, preferably, 1 to 4, more preferably, 1 to 3 and, most preferably, 1 to 2. The former right angled parallelogram corresponds to the projected outline profile of each tabular grain and the latter right angled parallelogram corresponds to a right angled parallelogram which circumscribes to the {100} faces of tabular grains.

In the present invention, the ratio of grains satisfying the relationship: length to width ratio >7 and/or crystal grains composed of at least two grains of such a configuration bound together at right angles or in parallel to the whole of AgX is 18% or less, preferably, 0 to 15%, more preferably, 0 to 10% and, most preferably, 0 to 2% by weight.

With respect to the halogen composition, the tabular grains are composed of AgBrICl, AgBr, AgBrI or a mixed crystal formed therefrom. The $I^-$ content of the tabular grains preferably ranges from 0 to 20 mol %, more preferably, from 0 to 10 mol %. The AgBr content preferably ranges from 50 to 100 mol %, more preferably, from 75 to 99.9 mol %.

Furthermore, such a form of grains that the $SCN^-$ or $I^-$ content of grain surface layer is at least 0.1 mol %, preferably, 0.5 to 50 mol % can be mentioned. Also, such a form that the $Br^-$ content of grain surface layer ranges from 1 to 100 mol %, preferably, 5 to 80 mol % can be mentioned. The term "grain surface layer" means portion consisting of 1 to 1000 atomic layers, preferably, 1 to 3 atomic layers, counted from the extreme surface. It is preferred that the above contents and surface layer thickness be distributed substantially uniformly over each grain surface and among grains.

The term "substantially uniform" means that the variation coefficient (standard deviation/average content) of the content distribution ranges preferably from 0 to 0.4, more preferably, 0 to 0.2 and, most preferably, 0 to 0.1.

Still a further form of grains such that at least one of $SCN^-$, $I^-$ and $Br^-$ is nonuniformly distributed over the grain surface (variation coefficient >0.4) can be mentioned. In particular, such a form that grains are heaped up at their edge portions or corner portions or in the vicinity thereof can be mentioned. For example, reference can be made to U.S. Pat. No. 5,275,930, the disclosure of which is incorporated by reference.

(IV) Formation of tabular grains will be described in detail below:

(IV)-1. Step of seed formation:

The tabular grains have crystal defects enabling preferential growth toward the edges, so that a tabular form is realized. The defects are produced during the formation of seeds for tabular grains. Some methods for forming the defects are, for example, as follows.

1) $Ag^+$ and $X^-$ are added to an aqueous solution containing compound $A^0$ and/or compound $B^0$. The defects occur when at least one of the compounds is adsorbed on formed AgX nuclei and $Ag^+$ and $X^-$ are laminated onto the nuclei. The defects may also occur when the added $Ag^+$ and $X^-$ cooperate with at least one of the compounds to thereby produce complexes and these complexes are included in the AgX nuclei.

2) First, $AgX^0$ nuclei which substantially do not contain any defects are formed in an aqueous solution of dispersion medium. Subsequently, at least one of the above compounds is added so that the compound is adsorbed on the $AgX^0$ nuclei. Then, $Ag^+$ and $X^-$ are added so that these are laminated onto the AgX nuclei to thereby form defects. The term "substantially" means that the amount of defects contained in the $AgX^0$ nuclei is in the range of, preferably, 0 to 20%, more preferably, 0 to 5% and, most preferably, 0 to 1% based on the amount of defects formed at the time of seed formation is finished.

The addition of the above compounds can be performed while adding $Ag^+$ and $X^-$, and also can be performed after the termination of the addition of $Ag^+$ and $X^-$. The addition of the compounds can be followed by further addition of $Ag^+$ and $X^-$ at the temperature unchanged or can be followed by first heating up by at least 3° C., preferably, 5 to 70° C. and, more preferably, 10 to 60° C. and subsequent addition of $Ag^+$ and $X^-$ to thereby form the defects. The latter is preferred. The additions can be performed under most desirably selected respective conditions.

3) At the time of forming AgX seeds, at least one gap interface between both sides of which are different in halogen composition is produced in the nuclei and crystal lattice strain is generated to thereby form the defects. For example, $Ag^+$ and $Xa^-$ are added to thereby first produce AgXa nuclei. Subsequently, $Ag^+$ and $Xb^-$ are added to thereby produce (AgXa|AgXb) seeds. In this instance, the composition of $Xa^-$ is different from that of $Xb^-$ by 10 to 100 mol %, preferably, 30 to 100 mol % and, more preferably, 50 to 100 mol % in the $Cl^-$, $Br^-$ or $I^-$ content. Each of the above $Xa^-$ and $Xb^-$ represents the halogen composition of added halogen salt solution. At least one, preferably, 1 to 5 and, more preferably, 2 to 4 gap interfaces are produced in each seed. Another method of forming (AgXa|AgXc) seeds is that after AgXa nuclei is formed, $Xc^-$ only is added, or $Xc^-$ and $Ag^+$ in a molar amount of $Xc^->Ag^+$, preferably, $Xc^->2\ Ag^+$ and, more preferably, $Xc^->5\ Ag^+$ are added. This method is preferred. The expression "$Xc^->2\ Ag^+$" means that the added molar amount of $Xc^-$ is greater than twice that of $Ag^+$. $Xc^-$ also represents the halogen composition of the added salt solution. The solubility of AgXc is preferably up to 1/1.5, more preferably, up to ⅓ and, most preferably, up to ⅛ of that of AgXa. In this case, a halogen conversion reaction occurs between added Xc and AgXa with the result that (AgXa|AgXc) is formed.

The method of adding $X^-$ may comprise first adding at least one member of $Cl_2$, $Br_2$ and $I_2$ and then adding a reducing agent to thereby produce $X^-$. The above member can be added in the form of any of a gas, an aqueous solution, a solid and an inclusion compound. Further, this addition can be performed by the mode: $X_2+X^{-\rightarrow(X_3)^-}$. For example, an aqueous solution of $(I3)^-$ can be mentioned. As the above reducing agent, use can be made of one capable of providing a standard electrode potential which is negative relative to the standard electrode potential of $X_2$+2 electrons ⇔ 2 $X^-$. Photographically inert reducing agents are preferably used, which include $H_2SO_3$. The addition can also be performed in the form of a mixed aqueous solution with the above carbohydrate.

Further, $Br^-$ or $I^-$ can be added by the method in which a $Br^-$ or $I^-$ emitting agent is first added to the reaction mixture and then $Br^-$ or $I^-$ is released. With respect to this method, reference can be made to JP-A-6-19029, EP 0561415A and U.S. Pat. No. 5,061,615, the disclosures of which re herein incorporated by reference.

Still further, use can be made of the method in which AgXa nuclei are first produced and AgXb fine grains are added and ripened to thereby form (AgXa|AgXb) halogen composition gap. Xa and Xb are as defined above. AgXb fine grains are those having a grain diameter of 0.15 μm or less, preferably, 0.003 to 0.07 μm and, more preferably, 0.005 to 0.05 μm.

4) Moreover, the defects can be formed by the method in which $I^-$ is incorporated in the aqueous solution of dispersion medium prior to nucleation and/or the method in which, for the addition of $Ag^+$ and $x^-$ at the time of nucleation, the addition of $X^-$ can be performed by the addition of a solution containing $I^-$ and $Cl^-$. In the former method, the addition amount of $I^-$ ranges from $10^{-5}$ to $10^{-1}$ mol/L, preferably, $10^{-4}$ to $10^{-2}$ mol/L. In the latter method, the $I^{-1}$ content is preferably 30 mol % or less, more preferably, in the range of 0.1 to 10 mol %. On the other hand, the $Cl^-$ content is preferably at least 30 mol %, more preferably, at least 50 mol %.

With respect to the defect formation in the above instances, its optimum amount is preferably decided depending on the configuration of finally formed AgX grains. When the amount of defect formation is too small, the proportion of the number of tabular grains to the number of AgX grains is unfavorably decreased. On the other hand, when the amount of defect formation is too large, a multiplicity of defects occur in each grain, so that the proportion of the number of grains with low aspect ratio to the number of AgX grains is unfavorably increased. Therefore, it is desirable to select a defect formation amount such that the proportion of the projected area of the tabular grains becomes a favorable value. In the methods 1) and 2) above, the greater the addition amount of the above compound, or the lower the gelatin concentration, or the greater the adsorptive strength of the above compound, the greater the amount of defect formation. In the method 3) above, the greater the above gap difference, or the greater the conversion amount, or the greater the addition amount of AgXa or AgXb, the greater the amount of defect formation. In the method 4) above, the greater the $I^-$ content, the greater the amount of defect formation.

In these methods, the amount of defect formation also depends on the pH and $X^-$ concentration of the reaction mixture. Therefore, optimum pH value and $X^-$ concentration can be selected. In the method (3) above, the halogen conversion reaction preferentially occurs at the edge and corner portions of AgXa nuclei, and the defects are preferentially formed there.

Of the methods 1) to 4) above, the methods 1) to 3) are preferred and the methods 1) and 2) are more preferred. The method 2) is most preferred because the method 2) is effective under low pH conditions (pH =1 to 6) as well to thereby ensure advantage in achieving the reduction of the tabular grain thickness. The term "nuclei" used in the present invention means minute AgX grains.

(IV)-2. Ripening, growth step and grain formation modes according to present invention:

The above formation of crystal defect containing seeds is preferably followed by a ripening step. Specifically, Ostwald ripening is carried out by heating up by at least 5° C., preferably, 10 to 70° C. and, more preferably, 20 to 70° C. so that nontabular grains are eliminated and the tabular grains are grown. This ripening can be carried out while adding $Ag^+$ and $X^-$ at a low rate. The ripening can also be performed at an increased $X^-$ concentration or in a AgX solvent, which is known per se, added to increase the degree of dissolution of AgX. With respect to the pH of the reaction mixture during the ripening, an appropriate value can be selected within the range of 1 to 11, preferably, 1.7 to 9. The addition amount of the AgX solvent ranges from 0 to $10^{-1}$ mol/L, preferably, 0 to $10^{-3}$ mol/L, and, after the ripening, the AgX solvent can be deactivated. For example, the deactivation can be performed by, in the use of $NH_3$, changing it to $NH_4^+$ and by, in the use of a thioether compound, oxidizing a thioether group thereof.

By virtue of the ripening, the proportion of the number of tabular grains is preferably increased to at least 1.5-fold, more preferably, 3 to 500-fold and, most preferably, 6 to 200-fold. The increase of the proportion of tabular grains is followed by the growth step. The grain formation modes of tabular grains according to the present invention are classified as follows:

(1) seed formation according to either one of the modes (IV)-1. 1) and 2), then optionally followed by measures for lowering adsorptive strength of the adsorbent, then optionally followed by ripening, and then followed by growth, provided that at least one of the optional steps can be omitted, if appropriate; and (2) seed formation according to either one of the modes (IV)-1. 3) and 4), then followed by ripening, and then followed by growth. The adsorbent $A^0$ and/or adsorbent $B^0$ with appropriate adsorptive strength can be added within a period from before ripening to 5 min before the termination of the growth, preferably, after ripening but before the growth.

The measures for lowering the adsorptive strength of the adsorbent will be described below. (i) In the use of adsorbent $A^0$, the pH is lowered to (adsorbent pKa +0.5) or less, preferably, (adsorbent's pKa +0.2) or less and, more preferably, between adsorbent pKa and (adsorbent's pKa—4.0). (ii) In the use of adsorbent $B^0$, the above adsorptive strength can be lowered by selecting the pH and $X^-$ concentration of the reaction mixture. In many instances, the lower the pH value of the reaction mixture, or the greater the $X^-$ concentration, the lower the adsorptive strength. The lowering of the pH value would convert the alcoholic hydroxy group to $-OH_2^+$ and react the alcoholic hydroxy group with a hydrogen halide to thereby induce the change:

$$R—OH+HX \rightarrow R—X+H_2O,$$

so that the above effect would be exerted. Further, the measures for lowering the adsorptive strength of the adsorbent include (iii) a method in which an oxidizer such as $H_2O_2$ or $KMnO_4$ is added to thereby oxidize the alcoholic hydroxy group into an aldehyde or a carboxylic acid, (iv) a method in which the alcoholic hydroxy group is esterified, (v) a method in which a dehydration reaction is carried out, and (vi) a method in which a reaction with a phosphorus trihalide is carried out. For details of these, reference can be made to Morrison Boyd Organic Chemistry, 6th edition, chapter 6, Tokyo Kagaku Dozin (1994); and The Chemistry of the hydroxyl group, edited by S. Patai, Interscience Publishers (1971), the disclosures of which are herein incorporated by reference.

Moreover, (vii) a method in which a dispersion medium capable of inhibiting the defect formation is added can be mentioned as the measure which is effective in both the adsorbents $A^0$ and $B^0$. For example, gelatin is added. In this instance, the ratio of the weight of gelatin to the weight of the adsorbent is increased to at least 0.1, preferably, 0.3 to 300 and, more preferably, 1 to 100. (viii) A method in which heating is conducted can be mentioned as the measure. When the temperature is raised, generally, the equilibrium of adsorption ⇔ desorption shifts toward the right side. The temperature is preferably raised by 5 to 60° C., more preferably, 10 to 50° C. (ix) A method in which part or all, preferably, 10 to 100%, more preferably, 20 to 90%, of the adsorbent is removed outside the system can be mentioned as the measure. For example, the centrifugal separation method or the filtration method using an ultrafilter member can be employed. In this instance, the removal is preferably conducted after the addition of the compound (vii) mentioned above, e.g. gelatin. Suitable dispersion medium and gelatin can be selected from the conventional photographic dispersion mediums, and reference can be made to the literature cited below. These measures enable substantially avoiding the defect formation during the growth period. In the present invention, in the above mode (2) as well, it is preferred that substantially no defect formation be conducted during the growth period. The term "substantially" means that the amount of defects formed during the growth period is up to 30%, preferably, 0 to 10% and, more preferably, 0 to 2% of the amount of defects existing just before the growth. In this instance, the capability of configuration control during the grain growth period is preferably sustained. When the adsorptive strength of the adsorbent is reduced, first, the capability of defect formation is extinguished. When the adsorptive strength is further reduced, the capability of configuration control is also decreased until it becomes identical with that of common gelatin. Therefore, the above mode can be realized by appropriately reducing the adsorptive strength. The term "capability of configuration control" means the power of making the equilibrium crystal habit potential defined in the above relationship of silver potential versus silver halide grain configuration, shift toward the lower potential side by at least 10 mV, preferably, 20 to 150 mV, more preferably, 30 to 120 mV and, most preferably, 50 to 100 mV relative to the gelatin system.

In the mode (2) above, the added adsorbent acts as a configuration controlling agent, not as the defect forming agent. A more straightforward explanation of the capability of configuration control is as follows. A mode is indicated in which, when the tabular grains are grown under the same conditions except for the presence of the controlling agent and the following condiitons, the thickness increase attained in the presence of the controlling agent during the growth is up to 80%, preferably, 0 to 60% and, more preferably, 0 to 30% of that attained in the absence of the controlling agent. The conditions exempted are the pH of the reaction mixture, i.e., optimum conditions (conditions for most effectively suppressing the thickness increase) can independently be selected within the range of 1 to 11. Further, the $X^-$ concentration can also be freely selected. In this case, the $X^-$ concentration leading to the formation of the tabular grains with the same thickness, exhibited in the presence of the controlling agent, are at least 1.5 times, preferably, 2 to 100 times that exhibited in the absence of the controlling agent.

The formation of the tabular grains in the presence of compound $C^0$ is described in EP 0534395A1. However, the effect of compound $A^0$ having per molecule at least two residual groups of covalently bonded compound $C^0$ is much greater than that of compound $C^0$ per se. The reason would be that the adsorption energy of compound $A^0$ having, per molecule, n molecules of compound $C^0$ bonded thereto is approximately $n \times EC^0$, provided that $EC^0$ represents the adsorption energy exhibited when the compound $C^0$ is adsorbed onto {100} faces of AgX grains. That is, the reason would be that, even if $EC^0$ is small, the adsorptive strength can substantially freely be selected by selecting the value of n. Therefore, at the time of crystal defect formation, a mode of large adsorptive strength can be realized. On the other hand, at the time of growth, the adsorptive strength can be reduced, for example, by regulating the pH to the pKa value of compound $A^0$ or below. The adsorptive strength can be reduced to substantially nil by lowering the pH to (pKa−1.0) or below. Therefore, there is an advantage that the adsorptive strength can freely be regulated within a wider range, so that a superior effect can be exerted.

Figure 2:
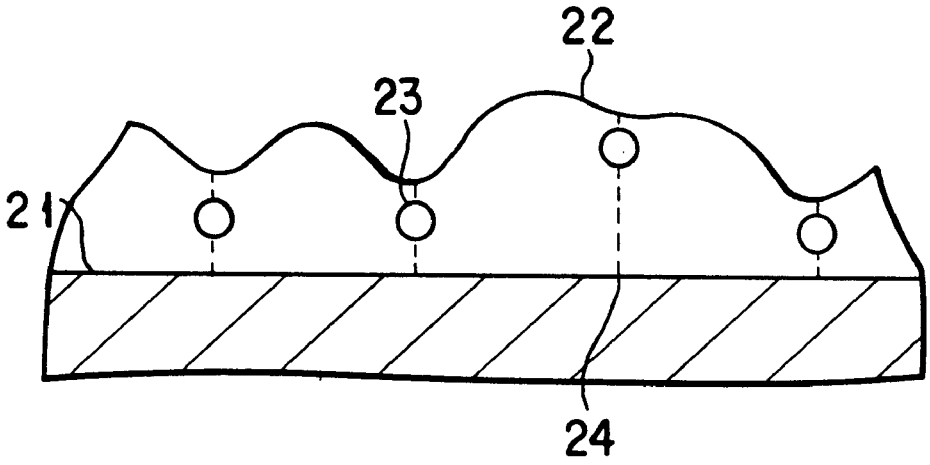
FIG. 2 is a schematic view showing a mode of adsorption of compound $A^0$.

As in the mode (2) above, when the compound $A^0$ is present at the time of growth, a mode such that there is no additional defect formation, growth inhibition is slight and grain configuration is controlled, can be realized by selecting compound $C^0$ with a small adsorptive strength in an initial stage and by selecting large n, i.e., the number of molecules of covalently bonded compound $C^0$. The reason would be as follows. Referring to FIG. 2, although a multiplicity of adsorption sites 24 per molecule are provided so that the adsorption mode is maintained, holding the capability of grain configuration control, the adsorptive strength of each adsorption site is so small that adsorption and desorption are frequently repeated at each adsorption site. The lamination of $Ag^+$ and $X^-$ becomes feasible at the time of the desorption. In FIG. 2, numeral 21 denotes the surface of a AgX grain, numeral 22 denotes the principal chain of the compound $A^0$, and numeral 23 denotes the residual group of compound $C^0$ covalently bonded to the principal chain of compound $A^0$.

On the other hand, the compound $B^0$ is also strongly adsorbed on the AgX grains so that the crystal defects can be formed and, further, enables controlling the growth performance substantially without forming the defects at the time of growth. The defect forming action of the polyhydric alcoholic compound and the configuration controlling action thereof at the time of growth of the tabular grains have not been recognized in the art and are novel. The effect of the polyhydric alcoholic compound is superior to that of the compound $A^0$. In this instance, the greater the number of alcoholic hydroxy groups per molecule (thus, the greater the molecular weight), or the greater the value of x1, i.e., the ratio of number of alcoholic hydroxy group to number of all functional groups, the greater the adsorptive strength. Therefore, the adsorptive strength can also be regulated by regulating these values.

With respect to both the adsorbents $A^0$ and $B^0$, the greater the proportion of nonadsorptive water-soluble functional groups per molecule, the smaller the adsorptive strength. The nonadsorptive water-soluble functional groups help the adsorbent to freely swim around in a nonadsorbed state in the reaction mixture. The adsorbents $A^0$ and $B^0$ can be used in combination in a suitable proportion.

The mode of adsorption of the polyhydric alcoholic compound onto the surface of AgX grains is complicated. When added at a pH regulated to the pKa or above, the compound $C^0$ is adsorbed on $Ag^+$ site of the surface of AgX grains to thereby lower the ion conductivity (σi) of AgX grains. However, when the compound $B^0$ was adsorbed on AgX grains, all of the cubic AgBr grains, octahedral AgBr grains and cubic AgCl grains had their σi values increased. This adsorbent, i.e., adsorbent capable of promoting the formation of {100} faces and increasing the σi of grains, has not been known and is a novel phenomenon. In particular, the increase of the σi of cubic AgBr grains was twice or more. Therefore, this adsorbent would exhibit a strong interaction with the $X^-$ of the surface of grains to thereby exert an effective configuration controlling capability. The σi was measured by a dielectric loss method.

In the present invention, it is preferred that the defect formation be substantially completed before the initiation of grain growth. The amount of silver salt added before the initiation of grain growth is preferably up to ½, more preferably, up to ¼ of the total amount of silver salt added throughout the grain formation.

During the seed formation and growth, it is more suitable to use the adsorbent in combination with gelatin than to use the adsorbent alone. Conventional gelatins can be used in a concentration of, preferably, 0.05 to 10 g/L and, more preferably, 0.2 to 5 g/L.

The ratio of the weight of adsorbent to the weight of gelatin preferably ranges from 0.01 to 0.9, more preferably, 0.03 to 0.5 and, most preferably, 0.06 to 0.3.

Although the temperature for seed crystal formation can be 10 to 90° C., the temperature for defect formation methods 1) and 2) above is preferably 30 to 90° C., more preferably, 40 to 85° C. The defect forming capability, exhibited in AgCl fine grains, of the compound $B^0$ is the maximum when the pH is approximately 4 at a temperature ranging from 50 to 85° C., and, the farther therefrom the pH value, the lower the defect forming capability.

(V) Other:

In the present invention, the term "seed formation period" means a period from the initiation of AgX nucleation to the start of temperature rise. The term "ripening period" means a period from the start of temperature rise to the start of growth. The term "growth period" means a period from the start of growth to the end of growth. The most suitable conditions combining a pH selected from within the range of 1 to 11, preferably, 1.7 to 9 and a $X^-$ concentration selected from within the range of up to $10^{-0.9}$ mol/L, preferably, $10^{-4}$ to $10^{-1.2}$ mol/L can be employed in the seed formation period, ripening period and growth period.

With respect to the above oxidizer and reducing agent, reference can be made to paragraphs "oxidizers" and "reducing agents" of "Kagaku Jiten (Chemical Dictionary)", Tokyo Kagaku Dozin (1994); JP-A-7-311428; "Shin Jikken Kagaku Koza (New Experimental Chemistry Course)" edited by the Chemical Society of Japan, vol. 15, oxidation and reduction, Maruzen Co., Ltd. (1976); "Koza Yuki Hanno Kiko (Seminar Mechanism of Organic Reaction)" edited by Minoru Imoto, vol. 10, Tokyo Kagaku Dojin (1965); "Yuki Kagobutsu no Sanka to Kangen (Oxidation and Reduction of Organic Compound)" edited by Yoshio Ogata, Nankodo Co., Ltd. (1963); JP-A-61-3134; and paragraphs "oxidizers" and "reducing agents" of "Kagaku Daijiten (Comprehensive Chemical Dictionary)", Kyoritsu Shuppan Co., Ltd. (1963), the disclosure of which are herein incorporated by reference.

After the formation of the tabular grains, the entire surface of the tabular grains can be covered with an AgX layer of halogen composition which is different from that of the grain surface. The thickness of the AgX layer is at least one atomic layer, preferably, 5 to $10^3$ atomic layers. Also, after the formation of the tabular grains, a rhodanate or halide solution can be added to thereby induce a halogen conversion reaction on the grain surface. The addition amount in molar thereof is 0.1 to $10^3$ times the molar amount of surface halogen atoms, i.e., at least one atomic layer, preferably 5 to $10^3$ atomic layers, of all the grains. The halide is selected from among $I^-$, $Br^-$ and mixtures of at least two members of $I^-$, $Br^-$ and $Cl^-$, the mixing ratio of which is not limited.

Gelatin whose methionine content is in the range of 0 to 40 $\mu$mol/g and modified gelatin described in JP-A-8-82883 (e.g., phtalated gelatin) can preferably be used as the dispersion medium in the grain formation. These can be used in an amount of 20 to 100% by weight, preferably, 50 to 100% by weight and, more preferably, 80 to 100% by weight based on the total weight of the dispersion medium.

Furthermore, it is preferred that measures for lowering the ability to form a complex with $Ag^+$ of the dispersion medium to 1 to 90% of the original ability, more preferably, measures for lowering the complex forming ability of a 1.0% by weight aqueous solution, at a pH of 2 to 4, of the dispersion medium to 3 to 70% of the original ability be implemented between the completion of $AgX^0$ nucleation and 5 min before the termination of the growth. Specifically, it is preferred to add an oxidizer, preferably, $H_2O_2$. For particulars of these, reference can be made to JP-A-7-311428, the disclosure of which is herein incorporated by reference.

In the present invention, the production of the tabular grains is carried out in the presence of the compound $A^0$ and/or compound $B^0$. With respect to the concentration of presence thereof, the compound $A^0$ and/or compound $B^0$ is added in such a concentration that the amount of equilibrium crystal habit potential shift is at least 10 mV, preferably, 20 to 150 mV, more preferably, 30 to 120 mV and, most preferably, 50 to 100 mV. In the case where both compound $A^0$ and compound $B^0$ are added, the above addition amounts are applied to the sum of these two compounds.

In the section (IV)-1-2) above, the $AgX^0$ nuclei have substantially none of the defects. This can be confirmed by the following method. $Ag^+$ and $X^-$ are added to the nuclei at low temperatures such as 25 to 40° C., in the absence of AgX solvent, without inducing Ostwald ripening and at an addition rate such that new nuclei are not formed, until all the nuclei are grown so as to have a diameter of approximately 0.3 $\mu$m. A transmission electron micrograph (TEM) of a replica film of the formed grains is obtained, its image is observed, and the proportion of tabular grains is counted. Growth with the use of gelatin of the above characteristic at a low supersaturation degree leads to formation of tabular grains having a higher aspect ratio.

Moreover, in the present invention, the tabular grains have dislocation lines. The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 35, 213 (1972). Illustratively, silver halide grains are harvested from the emulsion with the care that the grains are not so pressurized that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines with respect to each grain viewed from the direction perpendicular to the principal plane.

The average number of dislocation lines is preferably at least 5, more preferably, at least 10 per grain. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected. The dislocation lines can easily be observed by the above method.

Among the dislocation lines, there may be observed those which occur in a central zone of the principal plane and which do not reach sides constituting the edges.

The dislocation lines, for example, may be positioned either nearly uniformly over the entire zone of the edges of the tabular grains or at local points of the edges.

Thus, the position of the dislocation lines may be localized on the edges, principal plane or local points or on a combination thereof. That is, the dislocation lines may be simultaneously present on both the edges and the principal plane.

The method of introducing the dislocation lines will be described below.

The introduction of the dislocation lines in the tabular grains can be attained by providing at least one specific high silver iodide phase in the internal part of each grain. Herein, the term "phase" includes not only a layer surrounding all over a grain positioned therein, but also at least one region positioned at a specific part of a grain, for example, at a side, a corner and a face. Specifically, the tabular grains with dislocation lines can be obtained by firstly preparing base grains, then providing at least one high silver iodide phase on each base grain and covering the outside of the high silver iodide phase of each grain with a layer having a silver iodide content lower than that of the high silver iodide phase. The silver iodide content of the base tabular grains is lower than that of the high silver iodide phase and preferably ranges from 0 to 20 mol %, more preferably, 0 to 15 mol %.

The high silver iodide phase provided in the internal part of the grains consists of a silver halide solid solution containing silver iodide. This silver halide is preferably silver iodide, silver iodobromide or silver chloroiodobromide and is more preferably silver iodide or silver iodobromide, the silver iodide content of which is 10 to 40 mol %. Control for achieving selective presence of the high silver iodide phase provided in the internal part of the grains (hereinafter also referred to as "internal high silver iodide phase") on any of the sides, corners and faces of the base grains can be made by regulating conditions for formation of the base grains, conditions for formation of the internal high silver iodide phase and conditions for formation of the layer covering the outside of the internal high silver iodide phase. Among conditions for formation of the base grains, important factors include pAg (logarithm of inverse number of a silver ion concentration), the presence or absence, type and amount of a silver halide solvent and the temperature. The at least one internal high silver iodide phase can selectively be provided in the vicinity of apexes or on the faces of the base grains by carrying out the growth of the base grains at a pAg of up to 8.5, preferably, up to 8. On the other hand, the at least one internal high silver iodide phase can be provided on the sides of the base grains by carrying out the growth of the base grains at a pAg of at least 8.5, preferably, at least 9. The threshold value of pAg is varied up and down, depending on the temperature and the presence or absence, type and amount of silver halide solvent. When, for example, a thiocyanate is used as the silver halide solvent, the threshold value of pAg shifts toward a high value. The most important pAg value during growth is one at the final stage of growth of the base grains. On the other hand, even when the pAg during growth does not satisfy the above values, the selective position of the internal high silver iodide phase can be controlled by effecting regulation to the above pAg after the growth of the base grains and carrying out the ripening. In this instance, ammonia, an amine compound, a thiourea derivative or a thiocyanate salt is suitably used as the silver halide solvent. The methods known as the conversion methods can be used for the formation of the internal high silver iodide phase. These methods include one in which, during the grain formation, ions of a halogen whose solubility of the salt with a silver ion is lower than the solubility of the salt to be made between a silver ion and the halogen ion constituting the grains or the vicinity of the surface of the grains at that time, are added. In the present invention, it is preferred that the amount of the halogen ion whose salt with a silver ion has low solubility to be added is set to a certain value or more, relative to the surface area of the grains at that time, depending on the halogen composition. For example, during the grain formation, KI is preferably added in an amount within a given range relative to the surface area of silver halide grains at that time. Specifically, an iodide salt is preferably added in an amount ranging from $8.2\times10^{-5}$ to $2.4\times10^{-4}$ mol/m$^{2}$.

One method of forming at least one internal high silver iodide phase comprises simultaneously adding an aqueous solution of a halide salt including an iodide salt and an aqueous solution of a silver salt.

For example, an aqueous solution of KI and an aqueous solution of $AgNO_3$ are simultaneously added by a double jet method. The time when the addition starts and the time when the addition terminates of the aqueous solution of KI, and the time when the addition starts and the time when the addition terminates of the aqueous solution of $AgNO_3$ may differ from each other before or after. The addition molar ratio of the aqueous solution of $AgNO_3$ to the aqueous solution of KI is preferably at least 0.1, more preferably, at least 0.5 and, most preferably, at least 1. The total addition molar amount of the aqueous solution of $AgNO_3$ may fall within the silver excess region relative to the added iodide ion and halide ion in the system. In the above double jet addition methods of the aqueous solution of halide including iodide ion and the aqueous solution of silver salt, it is preferred that the pAg decrease with the passage of double jet addition time. The pAg prior to the initiation of the addition preferably ranges from 6.5 to 13, more preferably, 7.0 to 11. On the other hand, the pAg at the termination of the addition most preferably ranges from 6.5 to 10.0.

The lower the silver halide solubility in the mixture system, the more preferably can the above methods be carried out. Therefore, the temperature of the mixture system used in the formation of the high silver iodide phase preferably ranges from 30 to 80° C., more preferably, 30 to 70° C.

The most desirable method of forming the internal high silver iodide phase can be adding fine grain silver iodide (meaning silver iodide grains in minute form, applicable hereinafter), fine grain silver iodobromide, fine grain silver chloroiodide or fine grain silver chloroiodobromide. It is especially preferred to add fine grain silver iodide. Although the size of these fine grains generally ranges from 0.01 to 0.1 μm, fine grains having a size of less than 0.01 μm or more than 0.1 μm can also be employed. With respect to the method of preparing these fine grains silver halides, reference can be made to JP-A-2-44335, 1-183417, 1-183644, 1-183645, 2-43534 and 2-43535, the disclosures of which are herein incorporated by reference. The internal high silver iodide phase can be provided by adding these fine grain silver halides and ripening. When the fine grains are dissolved after the ripening, the above-mentioned silver halide solvents can be used. The added fine grains need not be immediately completely dissolved and disappear, and it is satisfactory if they are dissolved and disappear when the final grains are completed.

The silver iodide content of the outside layer covering the at least one internal high silver iodide phase is lower than that of the internal high silver iodide phase, and preferably ranges from 0 to 30 mol %, more preferably, 0 to 20 mol % and, most preferably, 0 to 10 mol %.

Although the temperature and pAg are arbitrary in the formation of the outside layer covering the internal high silver iodide phase, the temperature preferably ranges from 30 to 80° C., most preferably, 35 to 70° C., and the pAg preferably ranges from 6.5 to 11.5, more preferably, 6.5 to 9.5. The use of the above-mentioned silver halide solvent may be preferred. The most preferred silver halide solvent is a thiocyanate salt.

The {100} tabular grains used in the present invention may be formed into epitaxially grown grains before use. Further, grains with any of various known granular structures can be produced by, for example, using the grains as a substrate and laminating an AgX layer with a halogen composition different from that of the substrate.

Still further, a shallow internal latent emulsion may be formed from the tabular grains as a core before use. Moreover, core/shell grains can also be formed. With respect to these grains, reference can be made to JP-A-59-133542, JP-A-63-151618, U.S. Pat. Nos. 3,206,313, 3,317,322, 3,761,276, 4,269,927, 3,367,778, 5,563,025, and 5,667,959 the disclosures of which are herein incorporated by reference.

The radical scavenger used in the emulsion of the present invention will be described in detail below.

In the present invention, the term "radical scavenger" means a compound which substantially decolors galvinoxyl, i.e., which decreases the absorbance at 430 nm, when a 0.05 mmoldm$^{-3}$ ethanol solution of galvinoxyl and a 2.5 mmoldm$^{-3}$ ethanol solution of a test compound are mixed together at 25° C. in the stopped flow method and the change with time of the absorbance thereof at 430 nm is measured. When the compound is not soluble in the above concentration, the measurement may be made at a lowered concentration.

The galvinoxyl decoloring rate constant determined by the above method is preferably at least 0.01 mmol$^{-1}$s$^{-1}$dm$^{3}$, more preferably, at least 0.1 mmol$^{-1}$s$^{-1}$dm$^{3}$.

The method of determining the radical scavenging rate with the use of galvinoxyl is described in Microchemical Journal 31, 18–21 (1985). The stopped flow method is described in, for example, Bunko Kenkyu (Spectroscopic Research), vol. 19, no. 6, p. 321 (1970).

In the present invention, it is more preferred that the compounds represented by one of the general formulae (A—I) to (A—V) be used as the radical scavenger.

In the general formula (A—I), Ra1 represents an alkyl group, an alkenyl group, an aryl group, an acyl group, an alkyl- or arylsulfonyl group, an alkyl- or arylsulfinyl group, a carbamoyl group, a sulfamoyl group, an alkoxycarbonyl group or an aryloxycarbonyl group; and Ra2 represents a hydrogen atom or a group represented by Ra1, provided that, when Ra1 is an alkyl group, an alkenyl group or an aryl group, Ra2 represents an acyl group, an alkyl- or arylsulfonyl group, an alkyl- or arylsulfinyl group, a carbamoyl group, a sulfamoyl group, an alkoxycarbonyl group or an aryloxycarbonyl group and provided that Ra1 and Ra2 may be bonded together to form a 5 to 7-membered ring.

In the general formula (A—II), X represents a heteroring group; and R1 represents an alkyl group, an alkenyl group or an aryl group, provided that X and Rb1 may be bonded together to form a 5 to 7-membered ring.

In the general formula (A—III), Y represents a nonmetallic atom group required to form a 5-membered ring together with the —N═C— group or represents a nonmetallic atom group required to form a 6-membered ring together with the —N═C— group, wherein the terminal portion of Y at which Y bonds with the carbon atom of the —N═C— group is a group selected from the group consisting of —N(Rc1)—, —C(Rc2)(Rc3)—, —C(Rc4)═, —O— and —S—, each of which bonds with the carbon atom of the —N═C— group via the left side bond thereof, and the above Rc1 to Rc4 each represent a hydrogen atom or a substituent.

In the general formula (A—IV), Rd1 and Rd2 may be the same or different from each other and each represent an alkyl group or an aryl group, provided that, when both Rd1 and Rd2 are the same unsubstituted alkyl groups, each of Rd1 and Rd2 represents an alkyl group having at least 8 carbon atoms.

In the general formula (A—V), Re1 and Re2 may be the same or different from each other and each represent a hydroxylamino group, a hydroxyl group, an amino group, an alkylamino group, an arylamino group, an alkoxy group, an aryloxy group, an alkylthio group, an arylthio group, an alkyl group or an aryl group, provided that Re1 and Re2 do not simultaneously represent —NHRe3, wherein Re3 represents an alkyl group or an aryl group.

Ra1 and Ra2 may be bonded together and also X and R1 may be bonded together to form a 5 to 7-membered ring.

The compounds represented by the general formulae (A—I) to (A—V) will be described in greater detail below.

In the general formula (A—I), Ra1 represents an alkyl group, preferably, an alkyl group having 1 to 36 carbon atoms, such as methyl, ethyl, i-propyl, cyclopropyl, butyl, isobutyl, cyclohexyl, t-octyl, decyl, dodecyl, hexadecyl or benzyl; an alkenyl group, preferably, an alkenyl group having 2 to 36 carbon atoms, such as allyl, 2-butenyl, isopropenyl, oleyl or vinyl; an aryl group, preferably, an aryl group having 6 to 40 carbon atoms, such as phenyl or naphthyl; an acyl group, preferably, an acyl group having 2 to 36 carbon atoms, such as acetyl, benzoyl, pivaloyl, a-(2,4-di-tert-amylphenoxy)butyryl, myristoyl, stearoyl, naphthoyl, m-pentadecylbenzoyl or isonicotinoyl; an alkyl- or arylsulfonyl group, preferably, an alkyl- or arylsulfonyl group having 1 to 36 carbon atoms, such as methanesulfonyl, octanesulfonyl, benzenesulfonyl or toluenesulfonyl; an alkyl- or arylsulfinyl group, preferably, an alkyl- or arylsulfinyl group having 1 to 40 carbon atoms, such as methanesulfinyl or benzenesulfinyl; a carbamoyl group, including an N-substituted carbamoyl group, preferably, a carbamoyl group having 1 to 40 carbon atoms, such as N-ethylcarbamoyl, N-phenylcarbamoyl, N,N-dimethylcarbamoyl or N-butyl-N-phenylcarbamoyl; a sulfamoyl group, including an N-substituted sulfamoyl group, preferably, a sulfamoyl group having 1 to 40 carbon atoms, such as N-methylsulfamoyl, N,N-diethylsulfamoyl, N-phenylsulfamoyl, N-cyclohexyl-N-phenylsulfamoyl or N-ethyl-N-dodecylsulfamoyl; an alkoxycarbonyl group, preferably, an alkoxycarbonyl group having 2 to 36 carbon atoms, such as methoxycarbonyl, cyclohexyloxycarbonyl, benzyloxycarbonyl, isoamyloxycarbonyl or hexadecyloxycarbonyl; or an aryloxycarbonyl group, preferably, an aryloxycarbonyl group having 7 to 40 carbon atoms, such as phenoxycarbonyl or naphthoxycarbonyl. Ra2 represents a hydrogen atom or a group represented by Ra1. When Ra1 has at least one substituent listed below, the above number of carbon atoms described as being preferred for Ra1 does not contain the number of carbon atoms of the substituent (applicable to the number of carbon atoms specified below).

In the general formula (A—II), the a heteroring group represented by X is a 5 to 7-membered heteroring having, as a ring constituting atom, at least one atom selected from the group consisting of nitrogen, sulfur, oxygen and phosphorus atoms, wherein the bonding position of heteroring (position of monovalent group) preferably resides in a carbon atom, e.g., 1,3,5-triazin-2-yl, 1,2,4-triazin-3-yl, pyridin-2-yl, pyradinyl, pyrimidinyl, purinyl, quinolyl, imidazolyl, 1,2,4-triazol-3-yl, benzimidazol-2-yl, thienyl, furyl, imidazolidinyl, pyrrolinyl, tetrahydrofuryl, morpholinyl and phosphinolin-2-yl. R1 represents an alkyl group, an alkenyl group or an aryl group as defined above with respect to Ra1 of the general formula (A—I).

In the general formula (A—III), Y represents a nonmetallic atom group required to form a 5-membered ring together with the —N═C— group, examples of the formed cyclic group include imidazolyl, benzimidazolyl, 1,3-thiazol-2-yl, 2-imidazolin-2-yl, purinyl and 3H-indol-2-yl. Also, Y represents a nonmetallic atom group required to form a 6-membered ring together with the —N═C— group. Y has a terminal portion bonded with the carbon atom of the —N═C— group, and this terminal is a group selected from the group consisting of —N(Rc1)—, —C(Rc2)(Rc3)—, —C(Rc4)═, —O— and —S—, each of which bonds with the carbon atom of the —N═C— group via the left side bond thereof. The above Rc1 to Rc4 may be the same or different from each other and each represent a hydrogen atom or a substituent (e.g., an alkyl group, an alkenyl group, an aryl group, an alkoxy group, an aryloxy group, an alkylthio group, an arylthio group, an alkylamino group, an arylamino group and a halogen atom). Examples of 6-membered ring groups formed with Y include quinolyl, isoquinolyl, phthaladinyl, quinoxalinyl, 1,3,5-triazin-5-yl and 6H-1,2,5-thiadiazin-6-yl.

In the general formula (A—IV), Rd1 and Rd2 each represent an alkyl group, preferably, an alkyl group having 1 to 36 carbon atoms, such as methyl, ethyl, i-propyl, cyclopropyl, n-butyl, isobutyl, hexyl, cyclohexyl, t-octyl, decyl, dodecyl, hexadecyl or benzyl; or an aryl group, preferably, an aryl group having 6 to 40 carbon atoms, such as phenyl or naphthyl, provided that, when Rd1 and Rd2 are simultaneously the same unsubstituted alkyl groups each of Rd1 and Rd2 represents an alkyl group having at least 8 carbon atoms.

In the general formula (A—V), Re1 and Re2 each represent a hydroxylamino group, a hydroxyl group, an amino group, an alkylamino group, preferably, an alkylamino group having 1 to 50 carbon atoms, such as methylamino, ethylamino, diethylamino, methylethylamino, propylamino, dibutylamino, cyclohexylamino, t-octylamino, dodecylamino, hexadecylamino, benzylamino or benzylbutylamino; an arylamino group, preferably, an arylamino group having 6 to 50 carbon atoms, such as phenylamino, phenylmethylamino, diphenylamino or naphthylamino; an alkoxy group, preferably, an alkoxy group having 1 to 36 carbon atoms, such as methoxy, ethoxy, butoxy, t-butoxy, cyclohexyloxy, benzyloxy, octyloxy, tridecyloxy or hexadecyloxy; an aryloxy group, preferably, an aryloxy group having 6 to 40 carbon atoms, such as phenoxy or naphthoxy; an alkylthio group, preferably, an alkylthio group having 1 to 36 carbon atoms, such as methylthio, ethylthio, i-propylthio, butylthio, cyclohexylthio, benzylthio, t-octylthio or dodecylthio; an arylthio group, preferably, an arylthio group having 6 to 40 carbon atoms, such as phenylthio or naphthylthio; an alkyl group, preferably, an alkyl group having 1 to 36 carbon atoms, such as methyl, ethyl, propyl, butyl, cyclohexyl, i-amyl, sec-hexyl, t-octyl, dodecyl or hexadecyl; or an aryl group, preferably, an aryl group having 6 to 40 carbon atoms, such as phenyl or naphthyl, provided that Re1 and Re2 do not simultaneously represent —NHR wherein R represents an alkyl group or an aryl group.

Ra1 and Ra2 in the general formula (A—I) may be bonded together and also X and R1 in the general formula (A—II) may be bonded together to thereby form a 5 to 7-membered ring. Examples of the 5 to 7-membered rings include succinimide, phthalimide, triazole, urazole, hydantoin and 2-oxo-4-oxazolidinone rings.

The groups of the compounds of the general formulae (A—I) to (A—V) may be substituted with at least one substituent.

Examples of the substituent include an alkyl group, an alkenyl group, an aryl group, a heteroring group, a hydroxy group, an alkoxy group, an aryloxy group, an alkylthio group, an arylthio group, an amino group, an acylamino group, a sulfonamide group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group, an acyloxy group and a hydroxyamino group.

Among the compounds represented by the general formula (A—I), those wherein Ra2 represents a hydrogen atom, an alkyl group, an alkenyl group or an aryl group and Ra1 represents an acyl group, a sulfonyl group, a sulfinyl group, a carbamoyl group, a sulfamoyl group, an alkoxycarbonyl group or an aryloxycarbonyl group are preferred. Those wherein Ra2 represents an alkyl group or an alkenyl group and Ra1 represents an acyl group, a sulfonyl group, a carbamoyl group, a sulfamoyl group, an alkoxycarbonyl group or an aryloxycarbonyl group are more preferred. Those wherein Ra2 represents an alkyl group and Ra1 represents an acyl group are most preferred.

Among the compounds represented by the general formula (A—II), those wherein R1 represents an alkyl group or an alkenyl group are preferred, and those wherein R1 represents an alkyl group are more preferred. On the other hand, X preferably represents the ring formed with X1 and N═C as set forth in the following general formula (A—II-1), more preferably represents 1,3,5-triazin-2-yl and most preferably represents the group bonded to —N(Rb1)—OH as set forth in the following general formula (A—II-2). general formula (A—II-1)

general formula (A-II-1)

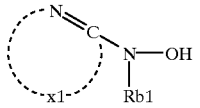

-continued general formula (A-II-2)

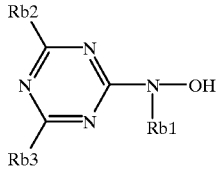

In the general formula (A—II-1), R1 has the same meaning as that of the general formula (A—II), and X1 represents a nonmetallic atom group required to form a 5 or 6-membered ring.

Among the compounds represented by the general formula (A—II-1), those wherein X1 forms a 5 or 6-membered aromatic heteroring are more preferred.

In the general formula (A—II-2), R1 has the same meaning as that of the general formula (A—II), and Rb2 and Rb3 may be the same or different from each other and each represent a hydrogen atom or a substituent.

Among the compounds represented by the general formula (A—II-2), those wherein each of Rb2 and Rb3 independently represents a hydroxyamino group, a hydroxyl group, an amino group, an alkylamino group, an arylamino group, an alkoxy group, an aryloxy group, an alkylthio group, an arylthio group, an alkyl group or an aryl group are especially preferred.

Among the compounds represented by the general formula (A—III), those wherein Y represents a nonmetallic atom group required to form a 5-membered ring are preferred, and those wherein the terminal atom of Y at which Y bonds with the carbon atom of the —N═C— group is a nitrogen atom is more preferred.

Those wherein Y forms an imidazoline ring are most preferred. This imidazoline ring may be condensed with a benzene ring.

Among the compounds represented by the general formula (A—IV), those wherein each of Rd1 and Rd2 independently represents an alkyl group are preferred.

In the general formula (A—V), it is preferred that each of Re1 and Re2 independently represent a group selected from the group consisting of a hydroxyamino group, an alkylamino group and an alkoxy group, and it is especially preferred that Re1 represents a hydroxyamino group and Re2 represents an alkylamino group.

Among the compounds represented by the general formulae (A—I) to (A—V), those whose total sum of the number of carbon atoms is 15 or less are preferred from the viewpoint that the compounds can act on layers other than the layer added with the compounds, and, contrarily, those whose total sum of the number of carbon atoms is 16 or more are preferred from the viewpoint that the compounds can act only on the layer added with the compounds.

Among the compounds represented by the general formulae (A—I) to (A—V), those represented by the general formulae (A—I), (A—II), (A—IV) and (A—V) are preferred, and those represented by the general formulae (A—I), (A—IV) and (A—V) are more preferred. Those represented by the general formulae (A—I) and (A—V) are much more preferred.

Examples of the compounds of the present invention represented by the general formulae (A—I) to (A—V) are set forth below, which in no way limit the scope of the invention.

A-1
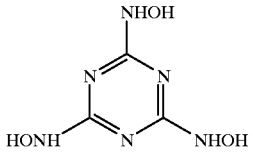
A-2
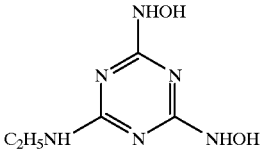
A-3
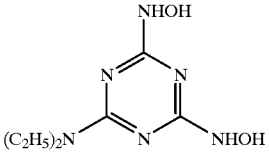
A-4
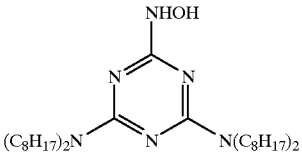
A-5
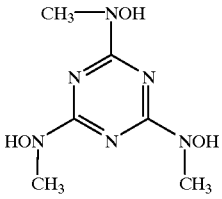
A-6
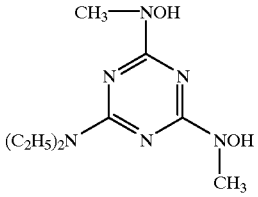
A-7
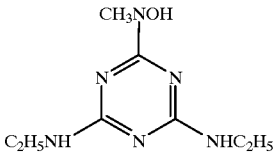
A-8
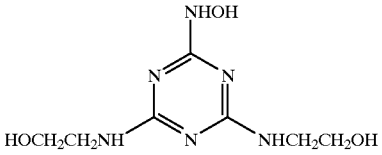

-continued
A-9
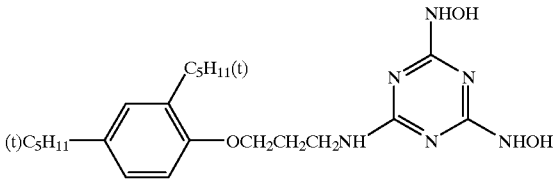
A-10
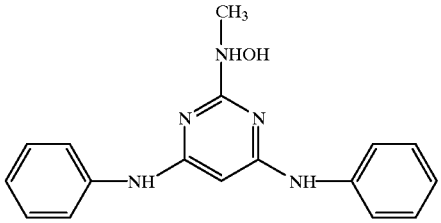
A-11
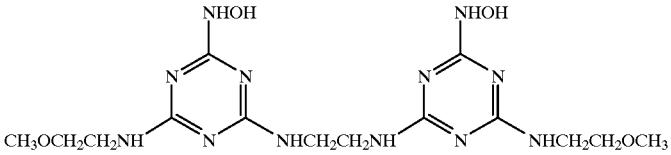
A-12
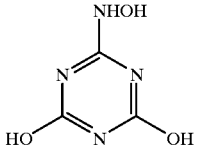
A-13
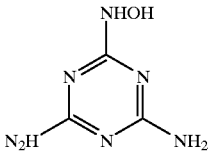
A-14
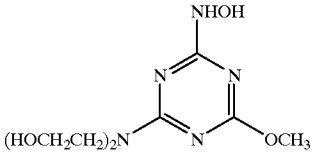
A-15
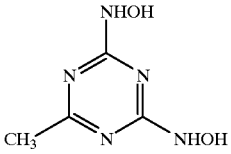
A-16
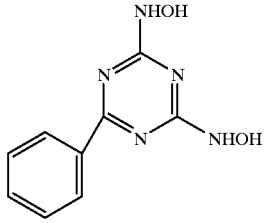

-continued
A-17
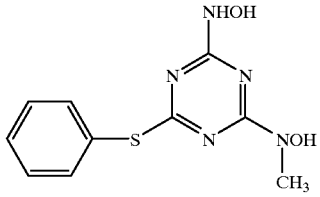
A-18
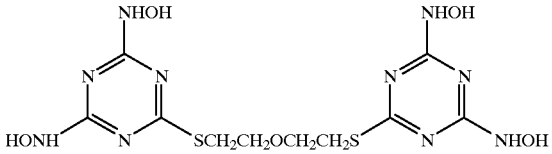
A-19
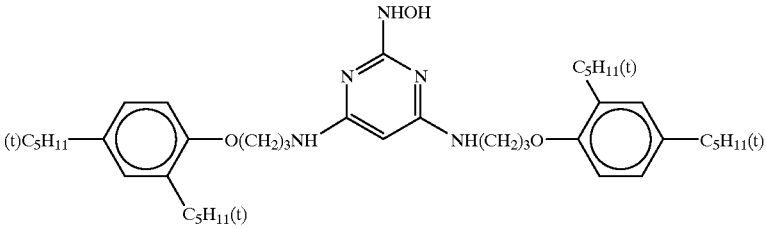
A-20
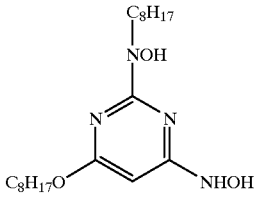
A-21
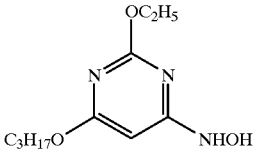
A-22
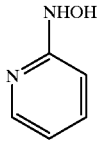
A-23
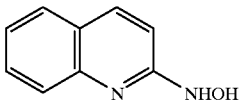
A-24
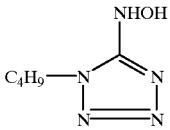

-continued
A-25
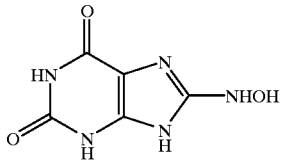
A-26
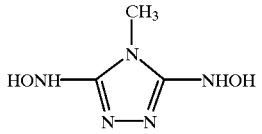
A-27
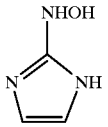
A-28
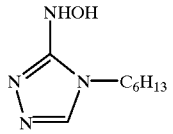
A-29
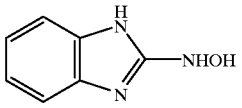
A-30
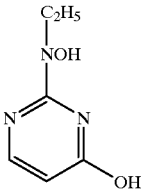
A-31
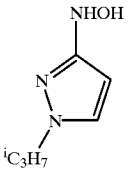
A-32
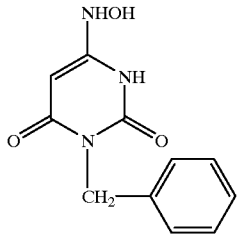

-continued
A-33
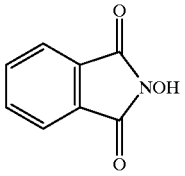
A-34
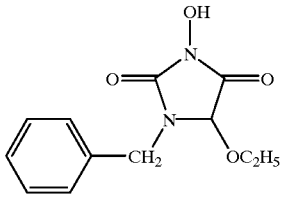
A-35
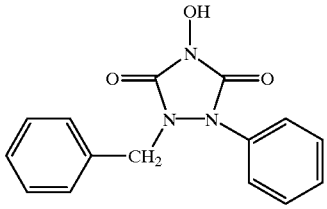
A-36
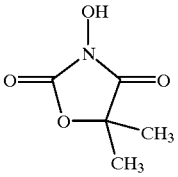
A-37
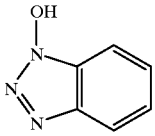
A-38
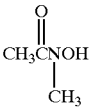
A-39
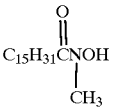
A-40
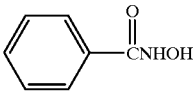

-continued
A-41
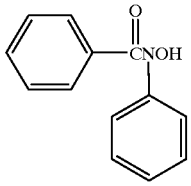
A-42
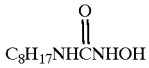
A-43
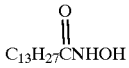
A-44
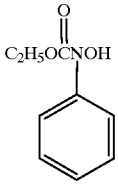
A-45
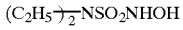
A-46
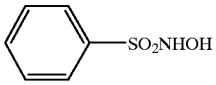
A-47
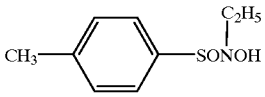
A-48
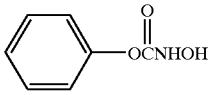
A-49
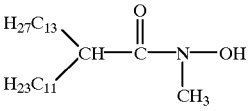
A-50
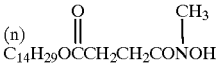
A-51
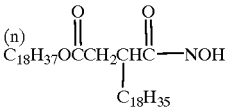
A-52
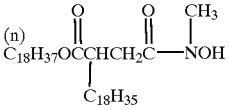

-continued

A-53

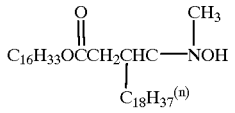

A-54

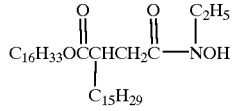

A-55

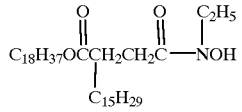

The correspondence between the above exemplified compounds and the above general formulae (A—I) to (A—V) is as follows:

general formula (A—I): compounds A-33 to A-55, general formula (A—II): compounds A-5 to A-7, A-10 and A-20, general formula (A—III): compounds A-21 to A-32, general formula (A—IV): compounds A-8, A-11 and A-19, and general formula (A—V): compounds A-1 to A-4, A-9 and A-12 to A-18.

These compounds of the present invention can be easily synthesized by or substantially in accordance with the method described in, for example, J. Org. Chem., 27, 4054 ('62), J. Amer. Chem. Soc., 73, 2981 ('51) and JP-B-49-10692.

In the present invention, the compounds represented by the general formulae (A—I) to (A—V) may be dissolved in water, a water soluble solvent such as methanol or ethanol or a mixture thereof, or emulsified and dispersed therein, in order to add into the emulsion.

When the compounds are dissolved in water, in the case where the solubility of the compound is increased at a high or low pH, the compound may be dissolved at such high or low pH, respectively before addition.

In the present invention, at least two of the compounds represented by the general formulae (A—I) to (A—V) may be used in combination.

For example, using a water soluble compound and an oil soluble compound in combination may be advantageous from the viewpoint of photographic performance.

In the present invention, although the radical scavenger can be added at any of the stages from during the grain formation to before the termination of chemical sensitization, it is preferred that the addition be conducted after the completion of reduction sensitization and, further, that the addition be conducted before the initiation of chemical sensitization. The pH at which the radical scavenger is added is preferably 7 or less, more preferably, 6 or less.

In the present invention, the term "before initiation of chemical sensitization" means a period preceding the addition of a chalcogen sensitizer, or gold sensitizer. The term "termination of chemical sensitization" means a time at which the temperature is lowered after chemical sensitization.

In the present invention, the addition amount of the radical scavenger preferably ranges from $1\times10^{-5}$ to $1\times10^{-2}$ mol/molAg, more preferably, $1\times10^{-4}$ to $5\times10^{-3}$ mol/molAg. In the case where plural radical scavengers are used, the above addition amounts are applied to the sum of the scavengers.

In a multilayer silver halide photographic lightsensitive material, a plurality of silver halide emulsions are commonly employed, and, when some thereof are emulsions according to the present invention, the radical scavenger is diffused throughout the lightsensitive material with the result that the addition amount of the radical scavenger to the emulsions according to the present invention becomes substantially decreased. Thus, the radical scavenger can further be added at the time of coating.

The silver halide emulsion of the present invention may be subjected to a reduction sensitization. The reduction sensitization can be performed during the grain formation or before, during or after a chemical sensitization after the grain formation.

The method of reduction sensitization can be selected from any one of the method in which a reduction sensitizer is added to the silver halide emulsion, the method commonly known as silver ripening in which grains are grown or ripened in an environment of pAg as low as 1 to 7 and the method commonly known as high-pH ripening in which grains are grown or ripened in an environment of pH as high as 8 to 11. At least two of these methods can be used in combination.

The method in which a reduction sensitizer is added is preferred from the viewpoint that the level of reduction sensitization can be finely regulated.

Known examples of suitable reduction sensitizers include stannous salts, ascorbic acid and its derivatives, amines and polyamines, hydrazine derivatives, formamidinesulfinic acid, silane compounds and borane compounds. For performing the reduction sensitization in the present invention, either one be selected from the above known reduction sensitizers and used or at least two may be selected from thereamong and used in combination. Preferred reduction sensitizers are stannous chloride, thiourea dioxide, dimethylaminoborane, ascorbic acid and derivatives thereof. Although the addition amount of the reduction sensitizer must be suitably selected because of the dependence thereof on the emulsion manufacturing conditions, the addition amount suitably ranges from $10^{-7}$ to $10^{-3}$ mol per mol of the silver halide.

The reduction sensitizer is dissolved in water or any of solvents such as alcohols, glycols, ketones, esters and amides is added to the emulsion. Although the reduction sensitizer may be put in a reactor vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of these solutions. Alternatively, the reduction sensitizer solution may preferably be either divided and added a plurality of times in accordance with the growth of grains or continuously added over a prolonged period of time.

An oxidizer capable of oxidizing silver is preferably added to the emulsion of the present invention during the process of producing the same. The silver oxidizer is a compound having an effect of acting on metallic silver to thereby convert the same to silver ion. A particularly effective compound is one that converts very fine silver grains, formed as by-products in the process of formation of silver halide grains and the process of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or organic substance. Examples of suitable inorganic oxidizers include ozone, hydrogen peroxide and its adducts (e.g., $NaBO_2.H_2O_2.3H_2O$, $3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2\{Ti(O_2)C_2O_4\}.3H_2O$, $4K_2SO_4.Ti(O_2)OH.SO_4.2H_2O$ and $Na_3\{VO(O_2)(C_2H_4)_2\}.6H_2O$), permanganates (e.g., $KMnO_4$), oxyacid salts such as chromates (e.g., $K_2Cr_2O_7$), halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the present invention are inorganic oxidizers of ozone, hydrogen peroxide and its adducts, halogen elements, and thiosulfonates, and organic oxidizers of quinones. The use of the silver oxidizer in combination with the above reduction sensitization is preferred. This combined use can be effected by performing the reduction sensitization after the use of the oxidizer or vice versa or by simultaneously performing the reduction sensitization and the use of the oxidizer. These methods can be selectively performed during the grain formation or chemical sensitization.

In any of the steps of the silver halide emulsion producing process, the silver halide grains for use in the present invention can be provided with at least one of sulfur sensitization, selenium sensitization, gold sensitization and noble metal sensitization such as palladium sensitization. Sensitization is preferably performed by a combination of these. Various types of emulsions can be prepared depending on in which of the steps the chemical sensitization is carried out. These include the type in which a chemical sensitization nucleus is implanted in an inner portion of the grains, the type in which the implantation is performed in a site shallow from the grain surface and the type in which the chemical sensitization nucleus is set in the grain surface. Although the position of the chemical sensitization nucleus can be selected depending on the object in the emulsion of the present invention, it is generally preferred that at least one chemical sensitization nucleus be provided in the vicinity of the grain surface.

A chemical sensitization which can preferably be carried out in the present invention is each or a combination of the chalcogen sensitization and the noble metal sensitization. The chemical sensitization can be performed by the use of active gelatin as described in T. H. James, The Theory of the Photographic Process, 4th ed., Macmillan, 1977, p.p. 67–76. Also, the chemical sensitization can be performed by the use of a sensitizer selected from sulfur, selenium, tellurium, gold, platinum, palladium, iridium and combinations thereof at a pAg of 5 to 10, a pH of 5 to 8 and a temperature of 30 to 80° C. as described in Research Disclosure, vol. 120, April 1974, 12008, Research Disclosure, vol. 34, June 1975, 13452, U.S. Pat. Nos. 2,642,361, 3,297,446, 3,772,031, 3,857,711, 3,901,714, 4,266,018 and 3,904,415 and GB (British Patent) 1,315,755. In the noble metal sensitization, use can be made of salts of noble metals such as gold, platinum, palladium and iridium and, especially, the gold sensitization, palladium sensitization and a combination thereof are preferred. In the gold sensitization, use can be made of known compounds such as chloroauric acid, potassium chloroaurate, potassium auriothiocyanate, gold sulfide and gold selenide. The palladium compound means divalent and tetravalent palladium salts. Preferred palladium compounds are represented by the formula:

$$R_2PdX_6 \text{ or } R_2PdX_4$$

wherein R is a hydrogen atom, an alkali metal atom or an ammonium group and X is a halogen atom selected from chlorine, bromine and iodine atoms.

Specifically, preferred use is made of $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$. The gold compound and palladium compound are preferably used in combination with a thiocyanate salt or a selenocyanate salt.

Suitable sulfur sensitizers include hypo, thiourea compounds, rhodanine compounds and sulfur-containing compounds described in U.S. Pat. Nos. 3,857,711, 4,266,018 and 4,054,457. Chemical sensitization can be effected in the presence of a chemical sensitization auxiliary commonly so termed. Suitable chemical sensitization auxiliaries are compounds capable of inhibiting fog in the course of chemical sensitization and capable of increasing sensitivity, such as azaindene, azapyridazine and azapyrimidine. Examples of chemical sensitization auxiliary modifiers are set forth in U.S. Pat. Nos. 2,131,038, 3,411,914 and 3,554,757, JP-A-58-126526 and the above Duffin, "Chemistry of Photographic Emulsion", p.p. 138–143.

In the emulsion of the present invention, it is preferred to employ the gold sensitization and the sulfur sensitization in combination. Each of the gold sensitizer and the sulfur sensitizer is preferably added in an amount of $1\times10^{-4}$ to $1\times10^{-7}$ mol, more preferably, $1\times10^{-5}$ to $5\times10^{-7}$ mol per mol of silver halide.

The selenium sensitization can be mentioned as a suitable sensitization method of the emulsion of the present invention. In the selenium sensitization, use can be made of known unstable selenium compounds, for example, colloidal metal selenium, selenoureas (e.g., N,N-dimethylselenourea and N,N-diethylselenourea), selenoketones, selenoamides and other selenium compounds. In the present invention, it is most preferred to employ the selenium sensitization in combination with the sulfur sensitization and gold sensitization.

The photographic emulsion of the present invention is preferably subjected to a spectral sensitization with at least one methine dye or the like, from the viewpoint that the effects desired in the present invention can be exerted.

Examples of usable dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have at least one substituent on carbon atoms thereof.

Any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GB 1,344,281 and 1,507,803, JP-B-43-4936 and 53-12375 and JP-A-52-110618 and 52-109925.

The emulsion of the present invention may be doped with a dye which itself exerts no spectral sensitizing effect or a substance which absorbs substantially none of visible radiation and exhibits supersensitization, together with the above spectral sensitizing dye.

The emulsion may be doped with the spectral sensitizing dye at any stage of the process for preparing the emulsion which is known as being useful. Although the doping is most usually conducted at a stage between the completion of the chemical sensitization and before the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains, such as the method disclosed in U.S. Pat. No. 4,183,756 and other methods.

The spectral sensitization of the silver halide emulsion of the present invention is preferably performed by the use of cyanine dye. The spectral sensitizing dye is preferably added in the emulsion simultaneously with the chemical sensitizer and, more preferably, the addition is conducted prior to the chemical sensitization.

The addition amount of the spectral sensitizing dye can range from $4\times10^{-6}$ to $8\times10^{-3}$ mol per mol of the silver halide.

The emulsion composed of {100} tabular grains according to the present invention can be used in combination with the emulsion composed of conventional chemically sensitized silver halide grains, hereinafter also referred to as "non-{100} tabular grains," in the same silver halide emulsion layer of a silver halide lightsensitive material. In particular, in the color photographic lightsensitive material, the {100} tabular grain emulsion and non-{100} tabular grain emulsion can be used in different emulsion layers and/or in the same emulsion layer. Examples of the non-{100} tabular grains include regular grains of cubic, octahedral, tetradecahedral or other regular crystals, {111} tabular grains and grains of spherical, potato-shaped or other irregular crystals.

These non-{100} tabular grains may be composed of any silver halide of silver bromide, silver iodobromide, silver iodochlorobromide, silver chlorobromide or silver chloride. Preferred silver halides are silver iodobromide or silver iodochlorobromide which contains silver iodide in an amount of up to 30 mol %. Silver iodobromide which contains silver iodide in an amount of 2 to 25 mol % is most preferred.

The non-{100} tabular grains used herein may be fine grains having a grain size of 0.1 $\mu$m or less and also may be large grains whose projected area diameter may reach up to 10 $\mu$m. The non-{100} tabular grains may form a monodispersed emulsion with narrow distribution or a polydispersed emulsion with wide distribution.

The non-{100} tabular grains for use in the present invention can be prepared by the process described in, for example, P. Glafkides, Chimie et Physique Photographique, Paul Montel, 1967; G. F. Duffin, Photographic Emulsion Chemistry (Focal Press, 1966); and V. L. Zelikman et al, Making and Coating Photographic Emulsion, Focal Press, 1964. That is, for example, all of the acid process, neutral process and ammonia process can be employed, and the reaction of a soluble silver salt and a soluble halogen salt can be performed by, for example, the one-side mixing method, the simultaneous mixing method or a combination thereof. Also, the method in which grains are formed in the presence of excess silver ion (known as the reverse mixing method) can be employed. The method in which the pAg of a liquid phase, in which a silver halide is formed, is held constant, namely, so-called controlled double jet method can be used as one mode of the simultaneous mixing method. This method enables obtaining a silver halide emulsion having regular crystal form and having nearly uniform grain size.

Separately formed at least two silver halide emulsions may be mixed together and used.

The silver halide emulsion composed of the above regular grains can be obtained by controlling the pAg and pH during the formation of grains. Details are described in, for example, Photographic Science and Engineering, vol. 6, pp. 159–165 (1962); Journal of Photographic Science, vol. 12, p. 242–251 (1964); and U.S. Pat. Nos. 3,655,394 and 1,413,748.

The monodispersed emulsion is described in, for example, JP-A-48-8600, 51-39027, 51-83097, 53-137133, 54-48521, 54-99419, 58-37635, and 58-49938, JP-B-47-11386, U.S. Pat. No. 3,655,394 and GB 1,413,748.

These non-{100} tabular grains may have crystal structures which are homogeneous or whose halogen composition of inner parts is different from that of outer parts, and also may have a layer structure. These emulsion grains are disclosed in, for example, GB 1,027,146, U.S. Pat. No. 3,505,068, U.S. Pat. No. 4,444,877 and JP-A-60-143331.

In the lightsensitive photographic material of the present invention, an emulsion of non lightsensitive fine grains of 0.6 μm or less, preferably, 0.2 μm or less may be added to a silver halide emulsion layer, an intermediate layer or a protective layer for the purpose of, for example, development acceleration, an improvement in preservability, effective utilization of reflected light, etc.

In the lightsensitive material of the present invention, it is only required that at least one silver halide emulsion layer selected from among a blue-sensitive layer, a green-sensitive layer and a red-sensitive layer be formed on a support. There is no particular limitation on the number of silver halide emulsion layers, the number of non lightsensitive layers and the layer sequence. A typical example is a silver halide photographic lightsensitive material having, on its support, at least one lightsensitive layer constituted by a plurality of silver halide emulsion layers which are sensitive to essentially the same color but have different sensitivities. This lightsensitive layer includes a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color.

Various non lightsensitive layers such as an intermediate layer can be formed between the silver halide lightsensitive layers and as the uppermost layer and the lowermost layer.

These intermediate layers may contain, e.g., couplers and DIR compounds as described in JP-A-61-43748, 59-113438, 59-113440, 61-20037 and 61-20038 and also may contain commonly employed color mixing inhibitors.

As for a plurality of silver halide emulsion layers constituting respective unit lightsensitive layer, a two-layered structure of high- and low-speed emulsion layers can be preferably used as described in DE (German Patent) 1,121,470 or GB 923,045. Generally, it is preferred that a layer arrangement be made so that the sensitivity is sequentially decreased toward a support, and a non lightsensitive layer may be disposed between silver halide emulsion layers. Also, as described in JP-A-57-112751, 62-200350, 62-206541 and 62-206543, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, layers can be arranged from the farthest side from a support in the order of blue-sensitive layer/GH/RH/GL/RL. Furthermore, as described in JP-A-56-25738 and JP-A-62-63936, layers can be arranged from the farthest side from a support in the order of blue-sensitive layer/GL/RL/GH/RH.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be adopted.

Furthermore, the arrangement can be changed as described above even when four or more layers are formed.

As apparent from the above, various layer structures and arrangements can be selected in conformity with the object of each lightsensitive material.

With respect to various techniques and organic and inorganic materials which can be employed in the silver halide photographic emulsion of the present invention and the silver halide photographic lightsensitive material using the same, use can generally be made of those described in Research Disclosure No. 308119 (1989) and No. 37038 (1995).

In addition, more specifically, for example, techniques and organic and inorganic materials which can be used in the silver halide photographic emulsion and the silver halide photographic material of the present invention are described in the following portions of EP 436,938A2 and the patents cited below, all the disclosures of which are herein incorporated by reference.

Item:Relevant part 1. silver halide emulsion: page 147, line 26 to page 148, line 12
2. Yellow coupler: page 137, line 35 to page 146, line 33 and page 149, lines 21 to 23
3. Magenta coupler: page 149, lines 24 to 28; EP 421,453A1, page 3, line 5 to page 25, line 55
4. Cyan coupler: page 149, lines 29 to 33; EP 432,804A2, page 3, line 28 to page 40, line 2
5. Polymer coupler: page 149, lines 34 to 38; EP 435,334A2, page 113, line 39 to page 123, line 37
6. Colored coupler: page 53, line 42 to page 137, line 34 and page 149, lines 39 to 45
7. Other functional couplers: page 7, line 1 to page 53, line 41 and page 149, line 46 to page 150, line 3; EP 435,334A2, page 3, line 1 to page 29, line 50
8. Antiseptic and mildewproofing agents: page 150, lines 25 to 28
9. Formalin scavenger: page 149, lines 15 to 17
10. Other additives: page 153, lines 38 to 47; EP 421,453A1, page 75, line 21 to page 84, line 56 and page 27, line 40 to page 37, line 40
11. Dispersion method: page 150, lines 4 to 24
12. Support: page 150, lines 32 to 34
13. Thickness/properties of film: page 150, lines 35 to 49
14. Color development step: page 150, line 50 to page 151, line 47
15. Desilvering step: page 151, line 48 to page 152, line 53
16. Automatic processor: page 152, line 54 to page 153, line 2
17. Washing with water/stabilization step: page 153, lines 3 to 37.

EXAMPLES

The present invention will be described in more detail below by way of its examples. However, the present invention is not limited to these examples.

Example 1 a. Preparation of tabular grains having no dislocation lines with the use of compound $B^0$:

Aqueous solution of gelatin no.1 (consisting of 1200 milliliter (hereinafter referred to as "mL") of $H_2O$, 25 g of gelatin and 0.36 g of KBr and exhibiting a pH of 4.2) was placed in a reaction vessel. While maintaining the temperature at 40° C. and stirring, a simultaneous mixing and addition of solution Ag-1 (1.17 mol/L $AgNO_3$) and solution X-1 (1.17 mol/L KBr) was carried out at a rate of 48 mL/min for 1 min. Two minutes later, 1N NaOH solution and aqueous solution of polyvinyl alcohol (consisting of 0.1 L of $H_2O$ and 5 g of polyvinyl alcohol (hereinafter also referred to as "PV-1") obtained from polyvinyl acetate and having an average polymerization degree of 500 at an average degree of saponification to alcoholic hydroxy group of 98%) were added, and the pH of the reaction mixture was adjusted to 5.0. The reaction mixture was allowed to stand still for 8 min and heated to 75° C. over a period of 12 min, and the pH thereof was adjusted to 6. Using the solution Ag-1 and solution X-2 (containing 1.136 mol/L of KBr and 0.0412 mol/L of KI), a double jet addition was performed for 89 min while maintaining the pBr at 3.1 under conditions such that the initial rate of the solution Ag-1 was 3.5 mL/min with the linear flow rate acceleration of 0.05 mL/min.

A precipitant was added, the temperature was lowered to 30° C. and the pH was adjusted to 4.0 to thereby precipitate the emulsion. The precipitated emulsion was washed with water, and gelatin solution was added at 38° C. to thereby redisperse the emulsion. The pH and pAg of the dispersion were adjusted to 6.2 and 8.8, respectively.

An aliquot of the emulsion was sampled, and a TEM image (transmission electron micrograph image) of a replica of emulsion grains was taken and observed. The observation showed that 94% of the total projected area of all AgX grains (hereinafter also referred to as "TPA") were occupied by tabular grains having principal planes composed of {100} faces and an aspect ratio of at least 3, whose projected outline profile was a right angled parallelogram. The average diameter, average aspect ratio, average length to width ratio and variation coefficient of the diameter distribution (standard deviation of distribution/average diameter, hereinafter also referred to as "C.V.") of the tabular grains were 0.63 μm, 6.3, 1.3 and 0.17, respectively. The halogen composition of the core portion of each grain was AgBr, the shell portion thereof had an iodine content of 3.5 mol % and the average iodine content of the whole grains was 3 mol %.

b. Preparation of tabular grains having dislocation lines at grain edges with the use of compound $B^0$:

Aqueous solution of gelatin no.1 (consisting of 1200 mL of $H_2O$, 25 g of gelatin and 0.36 g of KBr and exhibiting a pH of 4.2) was placed in a reaction vessel. While maintaining the temperature at 40° C. and stirring, a simultaneous mixing and addition of solution Ag-1 (1.17 mol/L $AgNO_3$) and solution X-1 (1.17 mol/L KBr) was carried out at a rate of 48 mL/min for 1 min. Two minutes later, 1N NaOH solution and the aqueous solution of polyvinyl alcohol (consisting of 0.1 L of $H_2O$ and 5 g of the polyvinyl alcohol (PV-1)) were added, and the pH of the reaction mixture was adjusted to 5.0. The reaction mixture was allowed to stand still for 8 min and heated to 75° C. over a period of 12 min, and the pH thereof was adjusted to 6. Using the solution Ag-1 and solution X-1, a double jet addition was performed for 89 min while maintaining the pBr at 3.1 under conditions such that the initial rate of the solution Ag-1 was 3.5 mL/min with the linear flow rate acceleration of 0.05 mL/min. During the double jet addition, when 80% of the total silver was added, the addition was interrupted and 3.5 g of KI was added and allowed to stand still for 5 min. Then, the double jet addition was resumed and the grain formation was completed.

A precipitant was added, the temperature was lowered to 30° C. and the pH was adjusted to 4.0 to thereby precipitate the emulsion. The precipitated emulsion was washed with water, and gelatin solution was added at 38° C. to thereby redisperse the emulsion. The pH and pAg of the dispersion were adjusted to 6.2 and 8.8, respectively.

An aliquot of the emulsion was sampled, and a TEM image (transmission electron micrograph image) of a replica of emulsion grains was taken and observed. The observation showed that 94% of the total projected area of all AgX grains (TPA) were occupied by tabular grains having principal planes composed of {100} faces and an aspect ratio of at least 3, whose projected outline profile was a right angled parallelogram. Dislocation lines were recognized on the edges of the tabular grains. The average diameter, average aspect ratio, average length to width ratio and variation coefficient of diameter distribution (C.V.) of the tabular grains were 0.60 μm, 5.4, 1.25 and 0.17, respectively. The average iodine content of the whole grains was 3.2 mol %.

c. Preparation of tabular grains having no dislocation lines with the use of compound $A^0$:

Grain formation was carried out in the same manner as in section a. above, except that an aqueous solution containing 10 g of polyvinylimidazole copolymer 1 represented by formula (6) below, in which x:y:z:w=60:7:13:30, having a weight average molecular weight of $1.5\times10^5$ was used in place of PV-1.

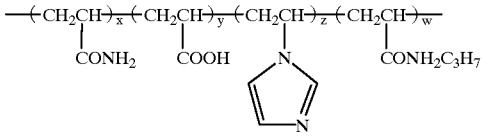

An aliquot of the emulsion was sampled, and a TEM image (transmission electron micrograph image) of a replica of emulsion grains was taken and observed. The observation showed that 94% of the total projected area of all AgX grains (TPA) were occupied by tabular grains having principal planes composed of {100} faces and an aspect ratio of at least 3, whose projected outline profile was a right angled parallelogram. The average diameter, average aspect ratio, average length to width ratio and variation coefficient of diameter distribution (C.V.) of the tabular grains were 0.63 μm, 6.3, 1.3 and 0.17, respectively. The halogen composition of the core portion of the grains was AgBr, the shell thereof had an iodine content of 3.5 mol % and the average iodine content of the whole grains was 3 mol %.

d. Preparation of tabular grains having dislocation lines on the edges with the use of compound $A^0$:

Grain formation was carried out in the same manner as in section b. above, except that the above aqueous solution containing 10 g of polyvinylimidazole copolymer 1 was used in place of PV-1.

An aliquot of the emulsion was sampled, and a TEM image (transmission electron micrograph image) of a replica of emulsion grains was taken and observed. The observation showed that 94% of the total projected area of all AgX grains (TPA) were occupied by tabular grains having principal planes composed of {100} faces and an aspect ratio of at least 3, whose projected outline profile was a right angled parallelogram. Dislocation lines were recognized on the edges of the tabular grains. The average diameter, average aspect ratio, average length to width ratio and variation coefficient of diameter distribution (C.V.) of the tabular grains were 0.60 μm, 5.4, 1.25 and 0.17, respectively. The average iodine content of the whole grains was 3.2 mol %.

e. Preparation of {111} tabular grains:

A 0.5M silver nitrate solution and a 0.5M potassium bromide solution were add ed each in an amount of 15 mL for 30 sec by the double jet method to 1.4 L of a 1.0% by weight gelatin solution containing 9.52 g of potassium bromide under agitation. During the addition, the temperature was maintained at 30° C. After the addition, the temperature was raised to 75° C. Thereafter, 105 mL of a 1.0M silver nitrate solution was slowly added, followed by the addition of $NH_4OH$. The pH was maintained at 9.5 for 15 min and was returned to the original, and a silver nitrate solution containing 150 g of silver nitrate was added over a period of 120 min at a flow rate accelerated, so that the final flow rate was 19 times the initial flow rate. During the addition, also, a solution of KBr (1.125 mol/L)+KI (0.045 mol/L) was added so as to maintain the pBr at 2.55.

Thereafter, the resultant emulsion was cooled to 35° C. and washed with water by the customary flocculation method. Gelatin solution was added to thereby redisperse the emulsion. At 40° C., the pH and pAg were adjusted to 6.5 and 8.6, respectively.

An aliquot of the emulsion was sampled, and a TEM image (transmission electron micrograph image) of a replica of emulsion grains was taken and observed. The observation showed that 94% of the total projected area of all AgX grains (TPA) consisted of tabular grains having principal planes composed of {111} faces and an aspect ratio of at least 3. The average diameter, average aspect ratio and variation coefficient of diameter distribution (C.V.) of the tabular grains were 1.4 μm, 5.9 and 0.19, respectively. The average iodine content of the whole grains was 3.2 mol %.

f. Preparation of {111} dislocated tabular grains:

A 0.5M silver nitrate solution and a 0.5M potassium bromide solution were added each in an amount of 15 mL for 30 sec by the double jet method to 1.4 L of a 1.0% by weight gelatin solution containing 9.52 g of potassium bromide under agitation. During the addition, the temperature was maintained at 30° C. After the addition, the temperature was raised to 75° C. Thereafter, 105 mL of a 1.0M silver nitrate solution was slowly added, followed by the addition of $NH_4OH$. The pH was maintained at 9.5 for 15 min and was returned to the original, and a silver nitrate solution containing 150 g of silver nitrate was added over a period of 120 min at a flow rate accelerated, so that the final flow rate was 19 times the initial flow rate. During the addition, also, a solution of KBr (1.17 mol/L) was added so as to maintain the pBr at 2.55. During the double jet addition, when 80% of the total silver was added, the addition was interrupted and 3.5 g of KI was added and allowed to stand still for 5 min. Then, the double jet addition was resumed and the grain formation was completed.

Thereafter, the resultant emulsion was cooled to 35° C. and washed with water by the customary flocculation method. Gelatin solution was added to thereby redisperse the emulsion. At 40° C., the pH and pAg were adjusted to 6.5 and 8.6, respectively.

An aliquot of the emulsion was sampled, and a TEM image (transmission electron micrograph image) of a replica of emulsion grains was taken and observed. The observation showed that 94% of the total projected area of all AgX grains (TPA) were occupied by tabular grains having principal planes composed of {111} faces and an aspect ratio of at least 3. Dislocation lines were recognized on the edges of the tabular grains. The average diameter, average aspect ratio and variation coefficient of diameter distribution (C.V.) of the tabular grains were 1.4 μm, 5.9 and 0.19, respectively. The average iodine content of the whole grains was 3.2 mol %.

The thus prepared emulsions a. to f. were provided with the following chemical sensitization at 60° C. and at a pH of 6.20 and a pAg of 8.40.

First, spectral sensitizing dyes S-6 and S-7 listed below were added in respective amounts of $1\times10^{-4}$ mol and $8\times10^{-4}$ mol per mol of silver.

Subsequently, per mol of silver, $3.0\times10^{-3}$ mol of potassium thiocyanate, $6\times10^{-6}$ mol of potassium chloroaurate and $1\times10^{-5}$ mol of sodium thiosulfate and, per mol of silver halide, $3\times10^{-6}$ mol of N,N-dimethylselenourea as a selenium sensitizer were added and ripened at 60° C. The ripening time was regulated so that the maximum sensitivity was attained at 1/100 sec exposure.

Each of the emulsions was doped with the following compounds after the completion of chemical sensitization and was coextruded together with a protective layer onto a support of triacetylcellulose film having a subbing layer so that the silver amount was 0.5 g/m$^2$, thereby obtaining lightsensitive materials a to f.

(1) Emulsion layer:

emulsion: one of emulsions a to f, compound C-7 of the following formula set forth below, tricresyl phosphate, stabilizer: 4-hydroxy-6-methyl-1,3,3a,7-tetrazaindene, and coating aid: sodium dodecylbenzenesulfonate.

(2) Protective layer:

fine grains of polymethyl methacrylate, 2,4-dichloro-6-hydroxy-s-triazine sodium salt, and gelatin.

The obtained samples were subjected to sensitometry exposure (1/100 sec) and developed in the following manner.

| (Processing solution) | |
|---|---|
| 1-phenyl-3-pyrazolidone | 0.5 g |
| hydroquinone | 10 g |
| disodium ethylenediaminetetraacetate | 2 g |
| potassium sulfite | 60 g |
| boric acid | 4 g |
| potassium carbonate | 20 g |
| sodium bromide | 5 g |
| diethylene glycol | 20 g |
| pH (adjusted with sodium hydroxide) | 10.0 |
| water q.s. ad 1L | |

Method of evaluating samples a. to f.:

(1) Sensitivity:

Comparison was made at a relative exposure that gives a density of fog+0.2. The evaluation was expressed by a relative value to the sensitivity of sample a, postulated as 100.

(2) Pressure properties:

Each of the samples was allowed to stand still for 14 hr under such conditions that the temperature and relative humidity were 40° C. and 70%, respectively, and placed in an atmosphere of 55% relative humidity for at least 3 hr. Thereafter, in the same atmosphere, a load of 4 g was applied to the sample by means of a needle having a diameter of 0.1 mm, by which the emulsion surface was scratched at a speed of 1 cm/sec. This sample was exposed for 1/100 sec and developed, and the density measurement was conducted at an aperture with a diameter of 25 μm.

The results are given in Table 1.

TABLE 1

| Lightsensitive material | Sensitivity | Pressure mark | Remarks |
|---|---|---|---|
| a | 100 | +0.30 | Comparison |
| b | 150 | +0.05 | Invention |
| c | 100 | +0.35 | Cornparison |
| d | 150 | +0.04 | Invention |
| e | 50 | +0.04 | Comparison |
| f | 100 | +0.10 | comparison |

As is apparent from the results of samples b and d specified in Table 1, the samples of the present invention have high sensitivity and excellent pressure properties.

Example 2

Preparation of sample 201

A multilayered color lightsensitive material comprising a support of 127 μm-thick undercoated cellulose triacetate film and, superimposed thereon, layers of the following compositions was prepared and designated sample 201. The value indicates the addition amount per square meter of the material. The effects of added compound are not limited to described use.

| | | |
|---|---|---|
| 1st layer (antihalation layer) | | |
| black colloidal silver | | 0.10 g |
| gelatin | | 1.90 g |
| ultraviolet absorbent U-1 | | 0.10 g |
| ultraviolet absorbent U-3 | | 0.040 g |
| ultraviolet absorbent U-4 | | 0.10 g |
| high b.p. org. solvent oil-1 | | 0.10 g |
| microcrystalline solid dispersion of dye E-1 | | 0.10 g |
| 2nd layer (interlayer) | | |
| gelatin | | 0.40 g |
| compound Cpd-C | | 5.0 mg |
| compound Cpd-J | | 5.0 mg |
| compound Cpd-K | | 3.0 mg |
| high b.p. org. solvent oil-3 | | 0.10 g |
| dye D-4 | | 0.80 mg |
| 3rd layer (interlayer) | | |
| surface and interior fogged fine granular silver iodobromide emulsion (av. grain size 0.06 μm, var. coeff. 18%, AgI cont. 1 mol %) | Ag qty. | 0.050 g |
| yellow colloidal silver | Ag qty. | 0.030 g |
| gelatin | | 0.40 g |
| 4th layer (low-speed red-sensitive emulsion layer) | | |
| emulsion A | Ag qty. | 0.30 g |
| emulsion B | Ag qty. | 0.20 g |
| gelatin | | 0.80 g |
| coupler C-1 | | 0.15 g |
| coupler C-2 | | 0.050 g |
| coupler C-3 | | 0.050 g |
| coupler C-9 | | 0.050 g |
| compound Cpd-C | | 5.0 mg |
| compound Cpd-J | | 5.0 mg |
| high b.p. org. solvent oil-2 | | 0.10 g |
| additive P-1 | | 0.10 g |
| 5th layer (medium-speed red-sensitive emulsion layer) | | |
| emulsion B | Ag qty. | 0.20 g |
| emulsion C | Ag qty. | 0.30 g |

-continued

| | | |
|---|---|---|
| gelatin | | 0.80 g |
| coupler C-1 | | 0.20 g |
| coupler C-2 | | 0.050 g |
| coupler C-3 | | 0.20 g |
| high b.p. org. solvent oil-2 | | 0.10 g |
| additive P-1 | | 0.10 g |
| 6th layer (high-speed red-sensitive emulsion layer) | | |
| emulsion D | Ag qty. | 0.40 g |
| gelatin | | 1.10 g |
| coupler C-1 | | 0.30 g |
| coupler C-2 | | 0.10 g |
| coupler C-3 | | 0.70 g |
| additive p-1 | | 0.10 g |
| 7th layer (interlayer) | | |
| gelatin | | 0.60 g |
| additive M-1 | | 0.30 g |
| color mixing inhibitor Cpd-I | | 2.6 mg |
| dye D-5 | | 0.020 g |
| dye D-6 | | 0.010 g |
| compound Cpd-J | | 5.0 mg |
| high b.p. org. solvent oil-1 | | 0.020 g |
| 8th layer (interlayer) | | |
| surface and interior fogged silver iodobromide emulsion (av. grain size 0.06 μm, var. coeff. 16%, AgI cont. 0.3 mol %) | Ag qty. | 0.020 g |
| yellow colloidal silver | Ag qty. | 0.020 g |
| gelatin | | 1.00 g |
| additive P-1 | | 0.20 g |
| color mixing inhibitor Cpd-A | | 0.10 g |
| compound Cpd-C | | 0.10 g |
| 9th layer (low-speed green-sensitive emulsion layer) | | |
| emulsion E | Ag qty. | 0.10 g |
| emulsion F | Ag qty. | 0.20 g |
| emulsion G | Ag qty. | 0.20 g |
| gelatin | | 0.50 g |
| coupler C-4 | | 0.10 g |
| coupler C-7 | | 0.050 g |
| coupler C-8 | | 0.10 g |
| compound Cpd-B | | 0.030 g |
| compound Cpd-D | | 0.020 g |
| compound Cpd-E | | 0.020 g |
| compound Cpd-F | | 0.040 g |
| compound Cpd-J | | 10 mg |
| compound Cpd-L | | 0.020 g |
| high b.p. org. solvent oil-1 | | 0.10 g |
| high b.p. org. solvent oil-2 | | 0.10 g |
| 10th layer (medium-speed green-sensitive emulsion layer) | | |
| emulsion G | Ag qty. | 0.30 g |
| emulsion H | Ag qty. | 0.10 g |
| gelatin | | 0.60 g |
| coupler C-4 | | 0.070 g |
| coupler C-7 | | 0.050 g |
| coupler C-8 | | 0.050 g |
| compound Cpd-B | | 0.030 g |
| compound Cpd-D | | 0.020 g |
| compound Cpd-E | | 0.020 g |
| compound Cpd-F | | 0.050 g |
| compound Cpd-L | | 0.050 g |
| high b.p. org. solvent oil-2 | | 0.010 g |
| 11th layer (high-speed green-sensitive emulsion layer) | | |
| emulsion I | Ag qty. | 0.50 g |
| gelatin | | 1.00 g |
| coupler C-4 | | 0.20 g |
| coupler C-7 | | 0.10 g |
| coupler C-8 | | 0.050 g |
| compound Cpd-B | | 0.080 g |
| compound Cpd-E | | 0.020 g |
| compound Cpd-F | | 0.040 g |
| compound Cpd-K | | 5.0 mg |
| compound Cpd-L | | 0.020 g |

-continued

| | | |
|---|---|---|
| high b.p. org. solvent oil-1 | | 0.020 g |
| high b.p. org. solvent oil-2 | | 0.020 g |
| 12th layer (interlayer) | | |
| gelatin | | 0.60 g |
| compound Cpd-L | | 0.050 g |
| high b.p. org. solvent oil-1 | | 0.050 g |
| 13th layer (yellow filter layer) | | |
| yellow colloidal silver | Ag qty. | 0.020 g |
| gelatin | | 1.10 g |
| color mixing inhibitor Cpd-A | | 0.010 g |
| compound Cpd-L | | 0.010 g |
| high b.p. org. solvent oil-1 | | 0.010 g |
| microcrystalline solid dispersion of dye E-2 | | 0.030 g |
| microcrystalline solid dispersion of dye E-3 | | 0.020 g |
| 14th layer (interlayer) | | |
| gelatin | | 0.60 g |
| 15th layer (low-speed blue-sensitive emulsion layer) | | |
| emulsion a (emulsion a prepared in Example 1) | Ag qty. | 0.50 g |
| gelatin | | 0.80 g |
| coupler C-5 | | 0.20 g |
| coupler C-6 | | 0.10 g |
| coupler C-10 | | 0.40 g |
| 16th layer (medium-speed blue-sensitive emulsion layer) | | |
| emulsion L | Ag qty. | 0.30 g |
| emulsion M | Ag qty. | 0.30 g |
| gelatin | | 0.90 g |
| coupler C-5 | | 0.10 g |
| coupler C-6 | | 0.10 g |
| coupler C-10 | | 0.60 g |
| 17th layer (high-speed blue-sensitive emulsion layer) | | |
| emulsion N | Ag qty. | 0.20 g |
| emulsion O | Ag qty. | 0.20 g |
| gelatin | | 1.20 g |
| coupler C-5 | | 0.10 g |
| coupler C-6 | | 0.10 g |
| coupler C-10 | | 0.60 g |
| high b.p. org. solvent oil-2 | | 0.10 g |
| 18th layer (1st protective layer) | | |
| gelatin | | 0.70 g |
| ultraviolet absorbent U-1 | | 0.20 g |
| ultraviolet absorbent U-2 | | 0.050 g |
| ultraviolet absorbent U-5 | | 0.30 g |
| formaldehyde scavenger compound Cpd-H | | 0.40 g |
| dye D-1 | | 0.15 g |
| dye D-2 | | 0.050 g |
| dye D-3 | | 0.10 g |
| 19th layer (2nd protective layer) | | |
| yellow colloidal silver | Ag qty. | 0.10 mg |
| fine granular silver iodobromide emulsion (av. grain size 0.06 μm, AgI cont. 1 mol %) | Ag qty. | 0.10 g |
| gelatin | | 0.40 g |
| 20th layer (3rd protective layer) | | |
| gelatin | | 0.40 g |
| polymethyl methacrylate (av. grain size 1.5 μm) | | 0.10 g |
| methyl methacrylate/acrylic acid 4:6 copolymer (av. grain size 1.5 μm) | | 0.10 g |
| silicone oil SO-1 | | 0.030 g |
| surfactant W-1 | | 3.0 mg |
| surfactant W-2 | | 0.030 g |

All the above emulsion layers were doped with additives F-1 to F-8 in addition to the above components, and, further, the layers were doped with gelatin hardener H-1 and surfactants for emulsification and coating W-3, W-4, W-5 and W-6 in addition to the above components. The chemical structures of the additive are set forth below.

Moreover, phenol, 1,2-benzisothiazolin-3-one, 2-phenoxyethanol, phenethyl alcohol and butyl p-hydroxybenzoate were added as antiseptic and mildew-proofing agents.

Preparation of dispersion of organic solid disperse dye:

Dye E-1 was dispersed by the following method.

Illustratively, water and 200 g of Pluronic F88 (trade name for ethylene oxide/propylene oxide block copolymer) produced by BASF were added to 1430 g of dye wet cake containing 30% of methanol and agitated, thereby obtaining a slurry having a dye content of 6%. 1700 mL of zirconia beads having an average grain size of 0.5 mm were charged into Ultraviscomill (UVM-2) manufactured by Aimex Co., Ltd. and the slurry was milled at a peripheral speed of about 10 m/sec and a delivery of 0.5 L/min for 8 hr. The beads were removed by filtration and the slurry was diluted with water into a dye concentration of 3%. The dilution was heated at 90° C. for 10 hr for stabilization. The obtained dye fine grains had an average grain size of 0.60 μm and a grain size distribution breadth (standard deviation of grain sizes× 100/average grain size) of 18%.

Solid dispersions of dyes E-2 and E-3 were obtained in the same manner. The average grain sizes thereof were 0.54 μm and 0.56 μm, respectively.

The characteristics of silver iodobromide emulsions A to I and L to O used in sample 201 and spectral sensitization of the emulsions are as follows.

TABLE 2

AgBrI emulsions used in Sample 201 are as follows:

| Emulsion | Characteristics of grains | Average eguivalent spherical diameter (μm) | coefficient of variation (%) | AgI content (%) |
|---|---|---|---|---|
| A | Monodisperse tetradecahedral grains | 0.28 | 16 | 4.0 |
| B | Monodisperse cubic internally fogged grains | 0.30 | 10 | 4.0 |
| C | Monodisperse cubic grains | 0.38 | 10 | 5.0 |
| D | Monodisperse tabular grains Av. asp. rt[1].:3.0 | 0.68 | 8 | 2.0 |
| E | Monodisperse cubic grains | 0.20 | 17 | 4.0 |
| F | Monodisperse tetradecahedral grains | 0.25 | 16 | 4.0 |
| G | Monodisperse cubic internally fogged grains | 0.40 | 11 | 4.0 |
| H | Monodisperse cubic grains | 0.50 | 9 | 3.5 |
| I | Monodisperse tabular grains Av. asp. rt[1].:5.0 | 0.80 | 10 | 2.0 |
| L | Monodisperse tabular grains Av. asp. rt[1].:5.0 | 0.55 | 10 | 2.0 |
| M | Monodisperse tabular grains Av. asp. rt[1].:8.0 | 0.70 | 13 | 2.0 |
| N | Monodisperse tabular grains Av. asp. rt[1].:6.0 | 1.00 | 10 | 1.5 |
| O | Monodisperse tabular grains Av. asp. rt[1].:9.0 | 1.20 | 15 | 1.5 |

note

[1]Av. asp. rt. signifies average aspect ratio.

TABLE 3

Spectral sensitization of emulsions A to I and L to O

| Emulsion | Spectral Sensitizers added | Addition amount per mol of silver halide (g) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |
| | S-5 | 0.070 |
| | S-9 | 0.10 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |

Subsequently, samples 202 to 206 were prepared by replacing the emulsion a of the 15th layer of sample 201 by emulsions b, c, d, e and f prepared in Example 1, respectively. Each of the samples was placed in an atmosphere of 55% relative humidity for 5 hr. Thereafter, in the same atmosphere, a load of 4 g was applied to the sample by means of a needle having a diameter of 0.1 mm, by which the emulsion surface was scratched at a speed of 1 cm/sec. The resultant samples were exposed for 1/100 sec and developed with the use of the following processing solutions.

| Processing step | Time (min) | Temp. (° C.) | Tank vol. (L) | Replenishment rate (mL/m$^2$) |
|---|---|---|---|---|
| 1st. development | 6 | 38 | 12 | 2200 |
| 1st. water washing | 2 | 38 | 4 | 7500 |
| reversal | 2 | 38 | 4 | 1100 |
| color development | 6 | 38 | 12 | 2200 |
| prebleaching | 2 | 38 | 4 | 1100 |
| bleaching | 6 | 38 | 12 | 220 |
| fixing | 4 | 38 | 8 | 1100 |
| 2nd. water washing | 4 | 38 | 8 | 7500 |
| final rinse | 1 | 25 | 2 | 1100 |

The composition of each processing solution was as follows.

| (1st development solution) | Tank soln. | Replenisher |
|---|---|---|
| pentasodium nitrilo-N,N,N-trimethylenephosphonate | 1.5 g | 1.5 g |
| pentasodium diethylenetriaminepentacetate | 2.0 g | 2.0 g |
| sodium sulfite | 30 g | 30 g |
| potassium hydroquinone-monosulfonate | 20 g | 20 g |
| potassium carbonate | 15 g | 20 g |
| sodium bicarbonate | 12 g | 15 g |
| 1-phenyl-4-methyl-4-hydroxymethyl-3-pyrazolidone | 1.5 g | 2.0 g |
| potassium bromide | 2.5 g | 1.4 g |
| potassium thiocyanate | 1.2 g | 1.2 g |
| potassium iodide | 2.0 mg | — |
| diethylene glycol | 13 g | 15 g |
| water | q.s. ad 1000 mL | q.s. ad 1000 mL |
| pH | 9.60 | 9.60 |

This pH was adjusted by the use of sulfuric acid or potassium hydroxide.

| (reversal solution) | Tank soln. | Replenisher |
|---|---|---|
| pentasodium nitrilo-N,N,N-trimethylenephosphonate | 3.0 g | same as the Tank soln. |
| stannous chloride dihydrate | 1.0 g | |
| p-aminophenol | 0.1 g | |
| sodium hydroxide | 8 g | |
| glacial acetic acid | 15 ml | |
| water | q.s. ad 1000 mL | |
| pH | 6.00 | |

This pH was adjusted by the use of acetic acid or sodium hydroxide.

| (Color developer) | Tank soln. | Replenisher |
|---|---|---|
| pentasodium nitrilo-N,N,N-trimethylenephosphonate | 2.0 g | 2.0 g |
| sodium sulfite | 7.0 g | 7.0 g |
| trisodium phosphate dodecahydrate | 36 g | 36 g |
| potassium bromide | 1.0 g | — |
| potassium iodide | 90 mg | — |
| sodium hydroxide | 3.0 g | 3.0 g |
| citrazinic acid | 1.5 g | 1.5 g |
| N-ethyl-N-(β-methanesulfonamidoethyl)-3-methyl-4-aminoaniline 3/2 sulfate monohydrate | 11 g | 11 g |
| 3,6-dithiaoctane-1,8-diol | 1.0 g | 1.0 g |
| water | q.s. ad 1000 mL | q.s. ad 1000 mL |
| pH | 11.80 | 12.00 |

This pH was adjusted by the use of sulfuric acid or potassium hydroxide.

| (Prebleaching) | Tank soln. | Replenisher |
|---|---|---|
| disodium ethylenediaminetetraacetate dihydrate | 8.0 g | 8.0 g |
| sodium sulfite | 6.0 g | 8.0 g |
| 1-thioglycerol | 0.4 g | 0.4 g |

-continued

| (Prebleaching) | Tank soln. | Replenisher |
|---|---|---|
| formaldehyde/sodium bisulfite adduct | 30 g | 35 g |
| water | q.s. ad 1000 mL | q.s. ad 1000 mL |
| pH | 6.30 | 6.10 |

This pH was adjusted by the use of acetic acid or sodium hydroxide.

| (Bleaching soln.) | Tank soln. | Replenisher |
|---|---|---|
| disodium ethylenediamine-tetraacetate dihydrate | 2.0 g | 4.0 g |
| Fe(III) ammonium ethylene-diaminetetraacetate dihydrate | 120 g | 240 g |
| potassium bromide | 100 g | 200 g |
| ammonium nitrate | 10 g | 20 g |
| water | q.s. ad 1000 mL | q.s. ad 1000 mL |
| pH | 5.70 | 5.50 |

This pH was adjusted by the use of nitric acid or sodium hydroxide.

| (Fixing solution) | Tank soln. | Replenisher |
|---|---|---|
| ammonium thiosulfate | 80 g | same as the Tank soln. |
| sodium sulfite | 5.0 g | |
| sodium bisulfite | 5.0 g | |
| water | q.s. ad 1000 mL | |
| pH | 6.60 | |

This pH was adjusted by the use of acetic acid or aqueous ammonia.

| (Stabilizer) | Tank soln. | Replenisher |
|---|---|---|
| 1,2-benzoisothiazolin-3-one | 0.02 g | 0.03 g |
| polyoxyethylene p-monononyl-phenyl ether (av. deg. of polymn. 10) | 0.3 g | 0.3 g |
| polymaleic acid (av. mol. wt. 2,000) | 0.1 g | 0.15 g |
| water | q.s. ad 1000 mL | q.s. ad 1000 mL |
| pH | 7.0 | 7.0 |

After the development processing, density differences in the yellow density of the highest density portion were measured with the use of an aperture having a diameter of 25 $\mu$m and the levels of stress marks were evaluated. The results are given in Table 4.

TABLE 4

| Sample No. | Density drop in the highest density portion | Remarks |
|---|---|---|
| 201 | 0.29 | Comparison |
| 202 | 0.08 | Invention |
| 203 | 0.31 | comparison |
| 204 | 0.09 | Invention |
| 205 | 0.50 | Comparison |
| 206 | 0.20 | comparison |

It is apparent from the results in Table 4 that, in the samples of the present invention, the drop of the highest density in the scratched portion is small and the stress marks are slight.

Example 3

Green-sensitive emulsion g was prepared in the same manner as the emulsion a of Example 1, except that the spectral sensitizing dyes S-6 and S-7 added in the chemical sensitization were respectively changed to:

spectral sensitizing dye S-4 $7.2\times10^{-4}$ mol/mol Ag, and spectral sensitizing dye S-5 $1.8\times10^{-4}$ mol/mol Ag.

Similar changes were effected to the emulsions b to f, thereby obtaining green-sensitive emulsions h to l. The sensitivity and pressure properties thereof were evaluated in the same manner as in Example 1. It was recognized that the emulsions of the present invention exhibited high sensitivity and slight stress marks.

Example 4

Red-sensitive emulsion m was prepared in the same manner as the emulsion a of Example 1, except that the spectral sensitizing dyes S-6 and S-7 added in the chemical sensitization were respectively changed to:

spectral sensitizing dye S-2 $8.73\times10^{-4}$ mol/mol Ag, and spectral sensitizing dye S-3 $0.27\times10^{-4}$ mol/mol Ag.

Similar changes were effected to the emulsions b to f, thereby obtaining red-sensitive emulsions n to r. The sensitivity and pressure properties thereof were evaluated in the same manner as in Example 1. It was recognized that the emulsions of the present invention exhibited high sensitivity and slight stress marks.

Example 5

Emulsions b-i to b-8 were prepared in the following manner, using the emulsion b described in Example 1, as the base emulsion.

(Emulsion b-1)

Compound A-4 within the scope of general formula (A-V) of the present invention was added in an amount of $3.3\times10^{-4}$ mol/mol Ag to the emulsion b, 11 min after the initiation of final shell formation.

(Emulsion b-2)

Compound A-4 within the scope of general formula (A-V) of the present invention was added in an amount of $3.3\times10^{-4}$ mol/mol Ag to the emulsion b, immediately prior to the water washing.

(Emulsion b-3)

Compound A-4 within the scope of general formula (A-V) of the present invention was added in an amount of $3.3\times10^{-4}$ mol/mol Ag to the emulsion b, prior to the addition of the spectral sensitizing dyes.

(Emulsion b-4)

Compound A-4 within the scope of general formula (A-V) of the present invention was added in an amount of $3.3\times10^{-4}$ mol/mol Ag to the emulsion b, upon the completion of the chemical sensitization.

(Emulsion b-5)

Compound A-3 within the scope of general formula (A-V) of the present invention was added in an amount of $3.3\times^{-4}$ mol/mol Ag to the emulsion b, prior to the addition of the spectral sensitizing dyes.

(Emulsion b-6)

Compound A-1 within the scope of general formula (A-V) of the present invention was added in an amount of $3.3\times10^{-4}$ mol/mol Ag to the emulsion b, prior to the addition of the spectral sensitizing dyes.

(Emulsion b-7)

Compound A-1 within the scope of general formula (A-V) of the present invention was added in an amount of $3.3\times10^{-5}$ mol/mol Ag to the emulsion b, prior to the addition of the spectral sensitizing dyes.

(Emulsion b-8)

Compound A-1 within the scope of general formula (A-V) of the present invention was added in an amount of $3.3\times10^{-3}$ mol/mol Ag to the emulsion b, prior to the addition of the spectral sensitizing dyes.

The same evaluation as in Example 1 was conducted of the emulsions b and b-1 to b-8, and the following results of Table 5 were obtained.

TABLE 5

| Lightsensitive material | Sensitivity | Pressure mark |
|---|---|---|
| b | 150 | +0.05 |
| b-1 | 180 | +0.02 |
| b-2 | 180 | +0.02 |
| b-3 | 180 | +0.02 |
| b-4 | 158 | +0.02 |
| b-5 | 165 | +0.02 |
| b-6 | 165 | +0.02 |
| b-7 | 165 | +0.02 |
| b-8 | 165 | +0.02 |

It is apparent from the results of Table 5 that the samples b-1 to b-8 are improved in sensitivity and stress marks as compared with the sample b which does not contain any radical scavenger as defined in the present invention.

The similar results as in Example 5 were obtained in both cases where compound A-42 was used instead of compound A-1, A-3 or A-4, and where compound A-48 was used instead of compound A-1, A-3 or A-4. Compounds A-42 and A-48 fall within the scope of general formula (A-I).

Example 6

The same evaluation as in Example 5 was conducted by using emulsion d, instead of emulsion b of Example 5, and the similar results as in Example 5 were obtained.

Example 7

Multilayer coated lightsensitive materials were produced from the emulsions b and b-1 to b-8 in the same manner as in Example 2. The same evaluation as in Example 2 was conducted thereof, and the similar results as in Example 5 were obtained.

The chemical formulae of compounds employed in the above Examples are set forth below:

C-1

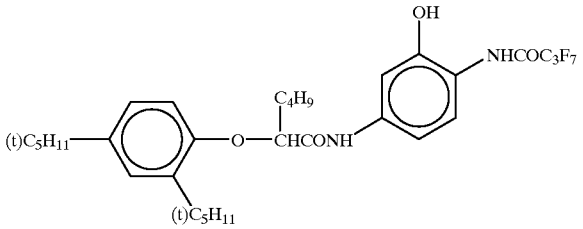

C-2

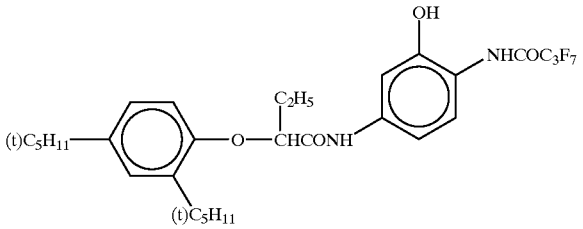

-continued
C-3
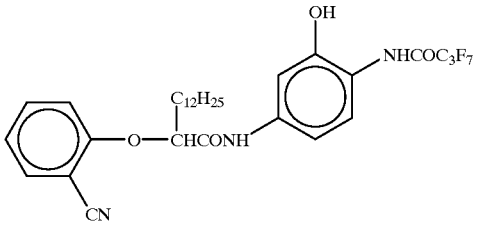
C-4
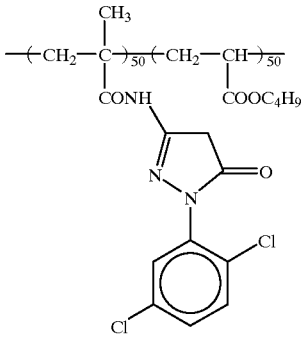
The unmbers are expnessed in wt%
Average mol. wt% :about 25,000
C-5
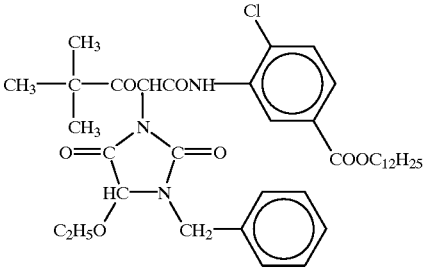
C-6
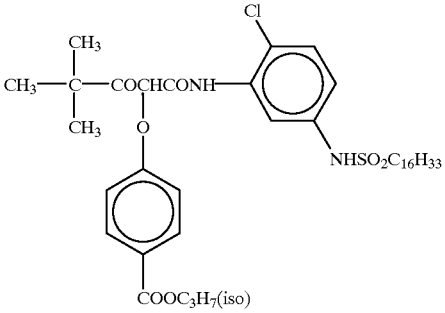
C-7
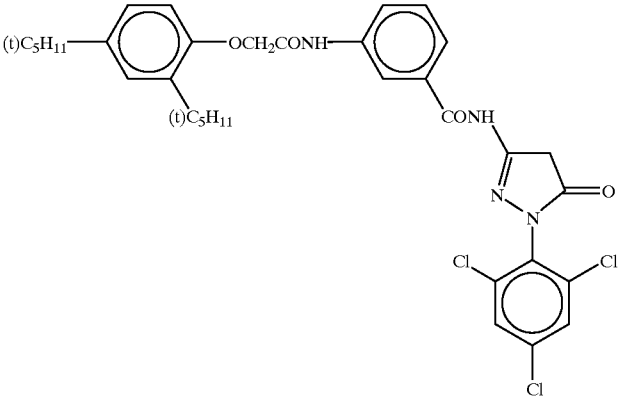
C-8
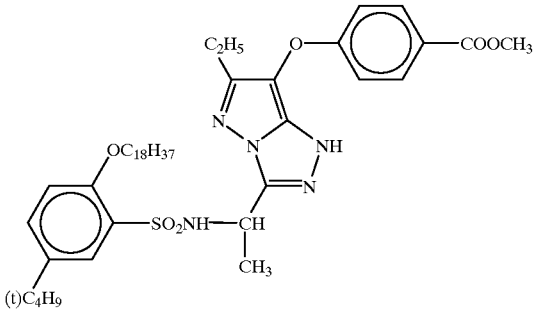
C-9
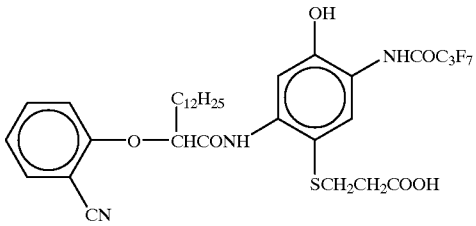

-continued
C-10
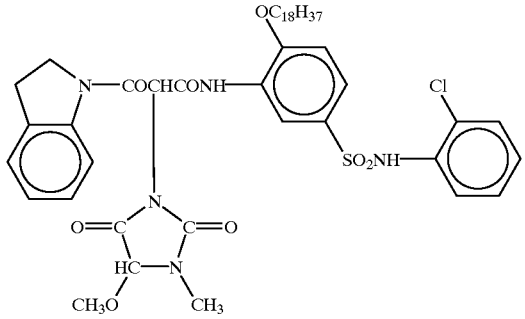
Oil-1
Dibutyl phthalate
Oil-2
Tricresyl phosphate
Oil-3
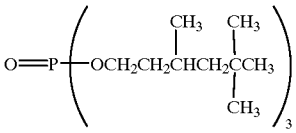
Cpd-A
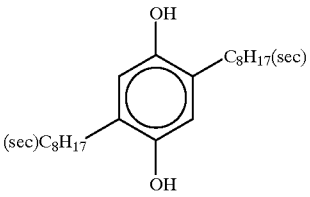
Cpd-B
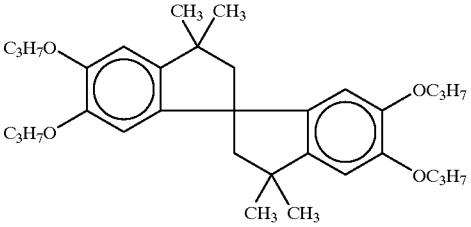
Cpd-C
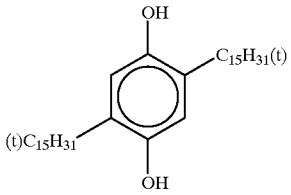
Cpd-D
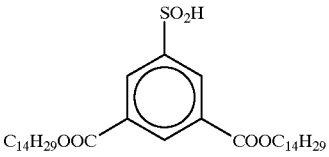
Cpd-E
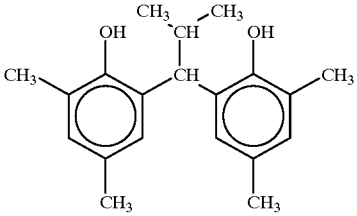
Cpd-F
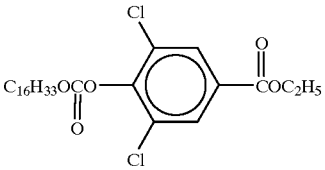
Cpd-H
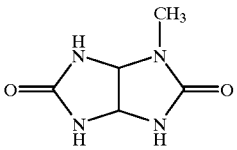
Cpd-I
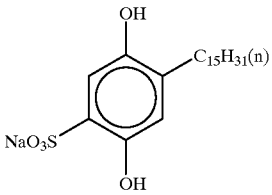
Cpd-J
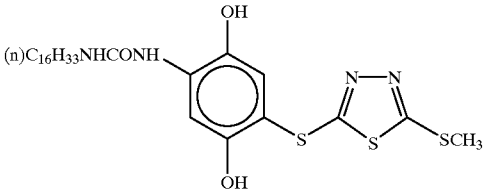

-continued
Cpd-K
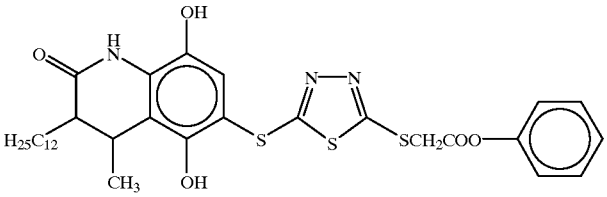
Cpd-L
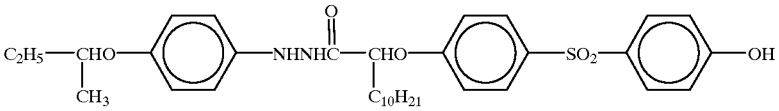
U-1
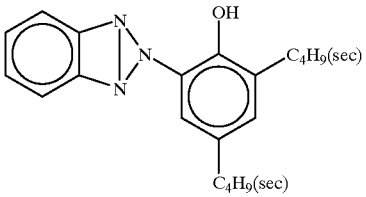
U-2
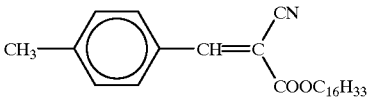
U-3
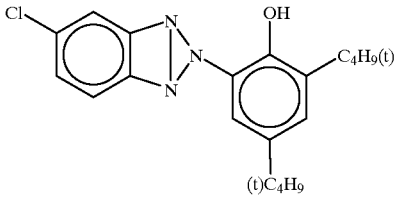
U-4
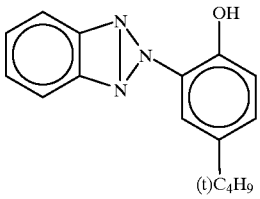
U-5
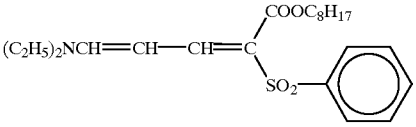
S-1
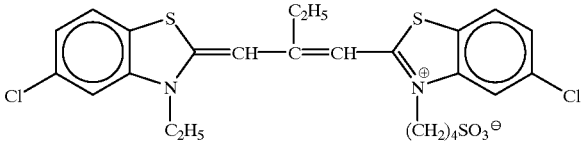
S-2
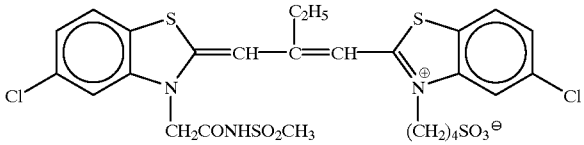
S-3
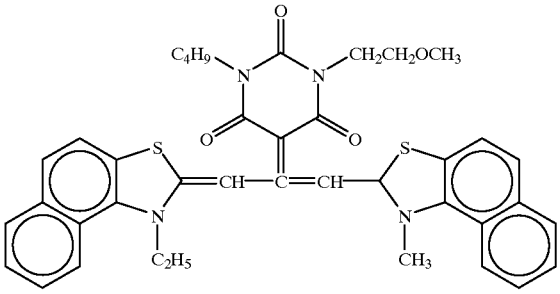
S-4
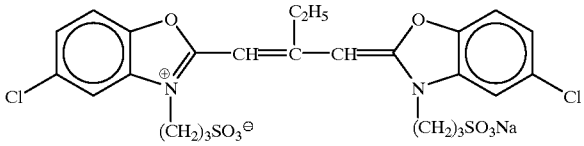

-continued
S-5
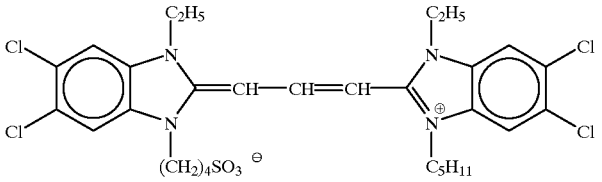
S-6
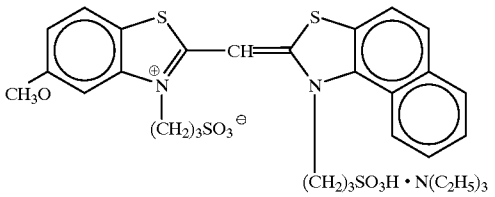
S-7
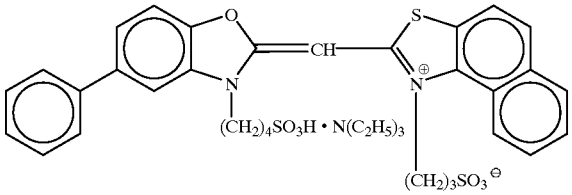
S-8
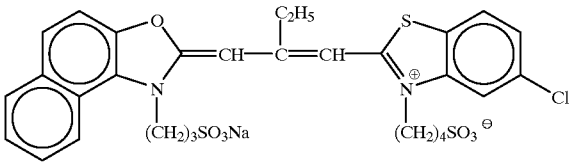
S-9
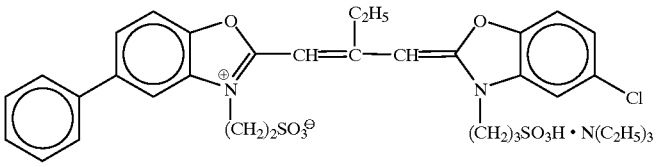
D-1
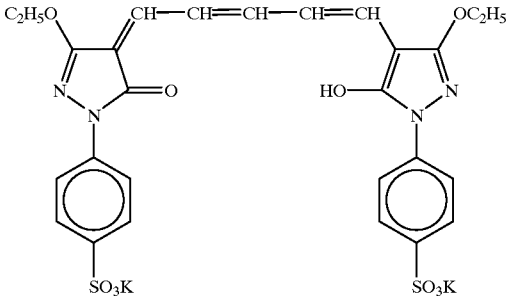
D-2
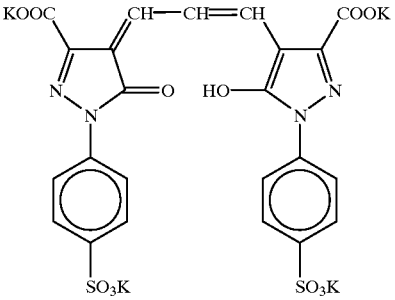
D-3
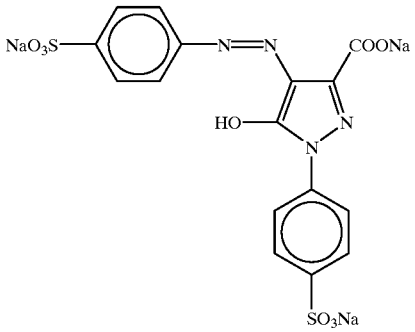
D-4
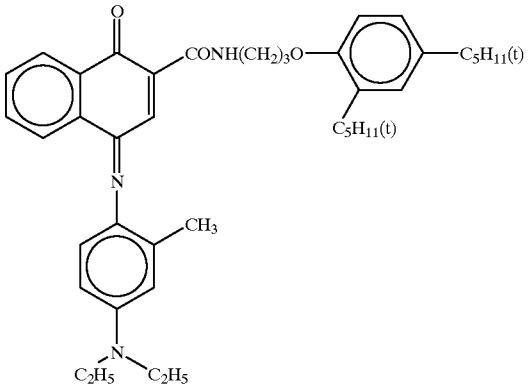

-continued
D-5
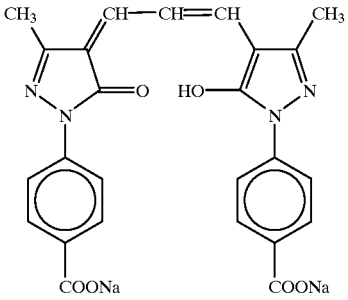
D-6
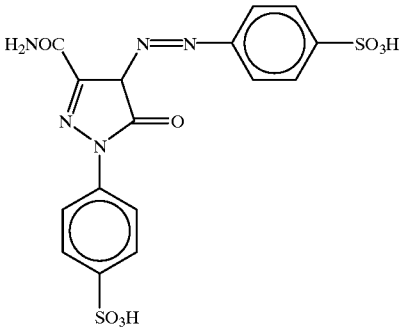
E-1
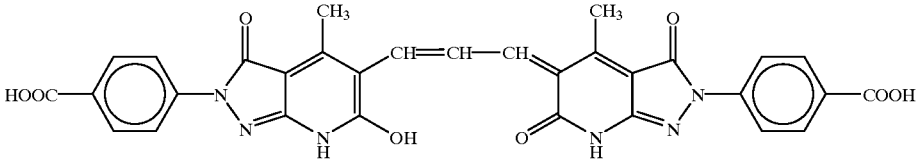
E-2
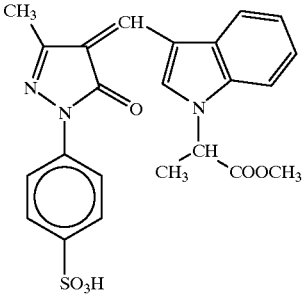
E-3
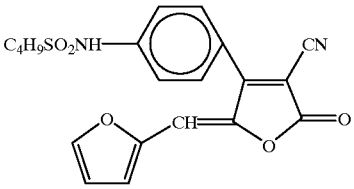
H-1
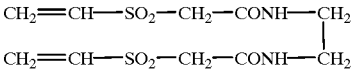
W-1
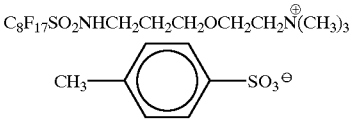
W-2
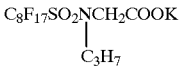
W-3
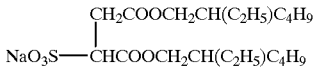
W-4
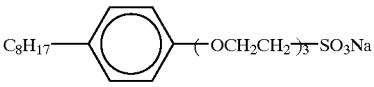
W-5
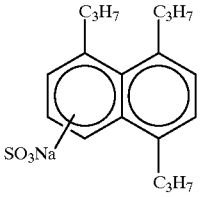
W-6
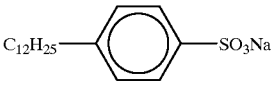
P-1
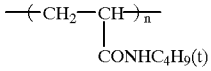
n = 100–1000

-continued

M-1

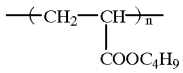

n = 100–1000

SO-1

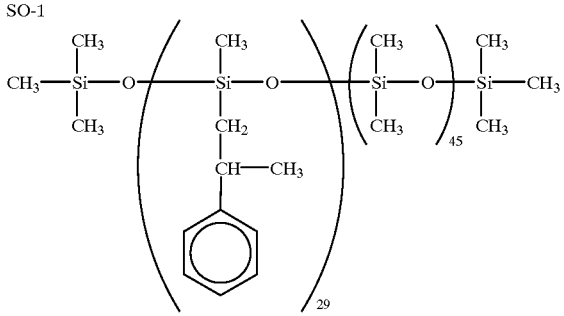

F-1

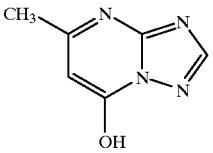

F-2

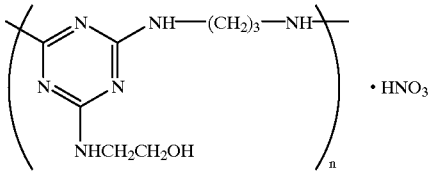

(n = 3–4)

F-3

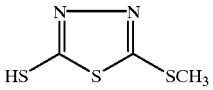

F-4

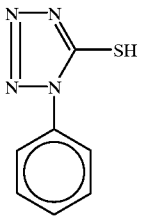

F-5

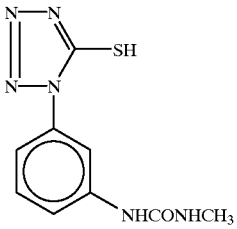

F-6

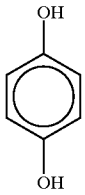

F-7

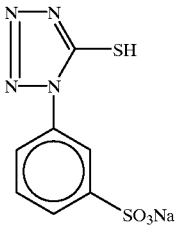

F-8

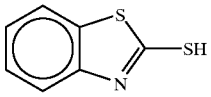

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide emulsion comprising a dispersion medium and silver halide grains, wherein at least 60% of the total projected area of all the silver halide grains in the emulsion are occupied by tabular grains each of which have {100} faces as principal planes;

an aspect ratio of at least 2.0 but less than 100;

a length to width ratio (long side/short side) in a form of a right angled parallelogram of 1 to 6, wherein the right angled parallelogram is the one that is surrounded by the {100} faces at the edges of the tabular grain or that is shaped by extending the {100} faces at the edges of the tabular grain;

at least one dislocation line localized on the edges of each tabular grain; and an average number of dislocation lines of at least 5 per grain.

2. The silver halide emulsion according to claim 1, wherein the emulsion was produced in the presence of a compound $A^0$ and/or compound $B^0$, wherein the compound $A^0$ is an organic compound constructed of a molecule and covalently bonded at least two residual groups of adsorbent thereto, wherein the adsorbent is capable of promoting formation of {100} faces in each silver halide grain;

the compound $B^0$ is an organic compound having at least two alcoholic hydroxy groups per molecule; and the compound $A^0$ and compound $B^0$ are organic compounds other than gelatin and protein.

3. The silver halide emulsion according to claim 2, wherein the emulsion further comprises at least one radical scavenger.

4. The silver halide emulsion according to claim 3, wherein the radical scavenger is represented by any of the following formulae (A-I) to (A-V):

general formula (A-I)

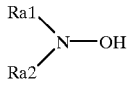

general formula (A-II)

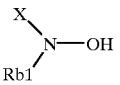

general formula (A-III)

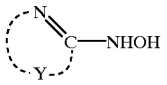

general formula (A-IV)

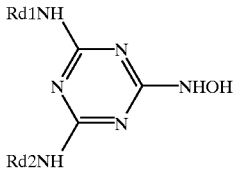

general formula (A-V)

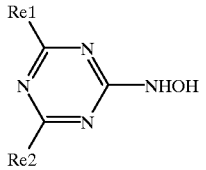

wherein, in the general formula (A-I), Ra1 represents an alkyl group, an alkenyl group, an aryl group, an acyl group, an alkyl- or arylsulfonyl group, an alkyl- or arylsulfinyl group, a carbamoyl group, a sulfamoyl group, an alkoxycarbonyl group or an aryloxycarbonyl group; and Ra2 represents a hydrogen atom or a group represented by Ra1; provided that, when Ra1 is an alkyl group, an alkenyl group or an aryl group, Ra2 represents an acyl group, an alkyl- or arylsulfonyl group, an alkyl- or arylsulfinyl group, a carbamoyl group, a sulfamoyl group, an alkoxycarbonyl group or an aryloxycarbonyl group; and provided that Ra1 and Ra2 may be bonded together to form a 5 to 7-membered ring;

in the general formula (A-II), X represents a heteroring group; and Rb1 represents an alkyl group, an alkenyl group or an aryl group, provided that X and Rb1 may be bonded together to form a 5 to 7-membered ring;

in the general formula (A-III), Y represents a nonmetallic atom group required to form a 5-membered ring together with the —N═C— group or represents a nonmetallic atom group required to form a 6-membered ring together with the —N═C— group, wherein the terminal portion of Y at which Y bonds with the carbon atom of the —N═C— group is a group selected from the group consisting of —N(Rc1)—, —C(Rc2)(Rc3)—, —C(Rc4)═, —O— and —S—, each of which bonds with the carbon atom of the —N═C— group via the left side bond thereof, and the above Rc1 to Rc4 each represent a hydrogen atom or a substituent;

in the general formula (A-IV), Rd1 and Rd2 may be the same or different from each other and each represent an alkyl group or an aryl group, provided that, when both Rd1 and Rd2 are the same unsubstituted alkyl groups, each of Rd1 and Rd2 represents an alkyl group having at least 8 carbon atoms; and in the general formula (A-V), Re1 and Re2 may be the same or different from each other and each represent a hydroxylamino group, a hydroxyl group, an amino group, an alkylamino group, an arylamino group, an alkoxy group, an aryloxy group, an alkylthio group, an arylthio group, an alkyl group or an aryl group, provided that Re1 and Re2 do not simultaneously represent —NHRe3, wherein Re3 represents an alkyl group or an aryl group.

5. The silver halide emulsion according to claim 2, wherein the compound $A^0$ is a polymer that is formed of one or more ethylenically unsaturated monomer units, and that has at least two imidazole groups or benzimidazole groups per molecule thereof.

6. The silver halide emulsion according to claim 2, wherein the compound $B^0$ is a polyvinyl alcohol that has a molecular weight of at least 300 and has an X1 value per molecule of 0.2 to 1.0, wherein the X1 value is a ratio of number of alcoholic hydroxy groups/number of all functional groups.

7. The silver halide emulsion according to claim 2, wherein the compound $A^0$ and/or compound $B^0$ is present in such a concentration that can provide an amount of an equilibrium crystal habit potential shift of at least 10 mV.

8. A color lightsensitive material comprising the silver halide emulsion according to claim 2.

9. The silver halide emulsion according to claim 1, wherein the emulsion further comprises at least one radical scavenger.

10. The silver halide emulsion according to claim 9, wherein the radical scavenger is represented by any of the following formulae (A-I) to (A-V):

general formula (A-I)

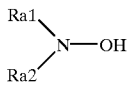

general formula (A-II)

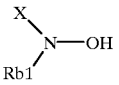

general formula (A-III)

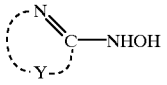

-continued general formula (A-IV)

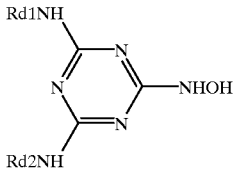

general formula (A-V)

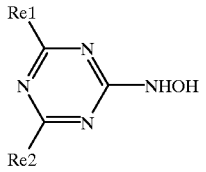

wherein, in the general formula (A-I), Ra1 represents an alkyl group, an alkenyl group, an aryl group, an acyl group, an alkyl- or arylsulfonyl group, an alkyl- or arylsulfinyl group, a carbamoyl group, a sulfamoyl group, an alkoxycarbonyl group or an aryloxycarbonyl group; and Ra2 represents a hydrogen atom or a group represented by Ra1; provided that, when Ra1 is an alkyl group, an alkenyl group or an aryl group, Ra2 represents an acyl group, an alkyl- or arylsulfonyl group, an alkyl- or arylsulfinyl group, a carbamoyl group, a sulfamoyl group, an alkoxycarbonyl group or an aryloxycarbonyl group; and provided that Ra1 and Ra2 may be bonded together to form a 5 to 7-membered ring;

in the general formula (A-II), X represents a heteroring group; and Rb1 represents an alkyl group, an alkenyl group or an aryl group, provided that X and Rb1 may be bonded together to form a 5 to 7-membered ring;

in the general formula (A-III), Y represents a nonmetallic atom group required to form a 5-membered ring together with the —N═C— group or represents a nonmetallic atom group required to form a 6-membered ring together with the —N═C— group, wherein the terminal portion of Y at which Y bonds with the carbon atom of the —N═C— group is a group selected from the group consisting of —N(Rc1)—, —C(Rc2)(Rc3)—, —C(Rc4)═, —O— and —S—, each of which bonds with the carbon atom of the —N═C— group via the left side bond thereof, and the above Rc1 to Rc4 each represent a hydrogen atom or a substituent;

in the general formula (A-IV), Rd1 and Rd2 may be the same or different from each other and each represent an alkyl group or an aryl group, provided that, when both Rd1 and Rd2 are the same unsubstituted alkyl groups, each of Rd1 and Rd2 represents an alkyl group having at least 8 carbon atoms; and in the general formula (A-V), Re1 and Re2 may be the same or different from each other and each represent a hydroxylamino group, a hydroxyl group, an amino group, an alkylamino group, an arylamino group, an alkoxy group, an aryloxy group, an alkylthio group, an arylthio group, an alkyl group or an aryl group, provided that Re1 and Re2 do not simultaneously represent —NHRe3, wherein Re3 represents an alkyl group or an aryl group.

11. The silver halide emulsion according to claim 1, wherein the silver bromide content of the silver halide emulsion is at least 50 mol %.

12. A color lightsensitive material comprising the silver halide emulsion according to claim 1.

13. The silver halide emulsion according to claim 1, wherein the average number of dislocation lines is at least 10 per grain.

* * * * *